US011418904B2

(12) United States Patent
Karapetyan et al.

(10) Patent No.: US 11,418,904 B2
(45) Date of Patent: Aug. 16, 2022

(54) DOWNMIXER, AUDIO ENCODER, METHOD AND COMPUTER PROGRAM APPLYING A PHASE VALUE TO A MAGNITUDE VALUE

(71) Applicant: Fraunhofer-Gesellschaft zur Förderung der angewandten Forschung e.V., Munich (DE)

(72) Inventors: Aleksandr Karapetyan, Erlangen (DE); Felix Wolf, Erlangen (DE); Jan Plogsties, Erlangen (DE)

(73) Assignee: Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 127 days.

(21) Appl. No.: 17/061,993

(22) Filed: Oct. 2, 2020

(65) Prior Publication Data

US 2021/0021955 A1 Jan. 21, 2021

Related U.S. Application Data

(63) Continuation of application No. PCT/EP2019/058713, filed on Apr. 5, 2019.

(30) Foreign Application Priority Data

Apr. 6, 2018 (EP) ..... 18166174

(51) Int. Cl.
*H04S 7/00* (2006.01)
*H04R 5/04* (2006.01)

(52) U.S. Cl.
CPC ..... *H04S 7/307* (2013.01); *H04R 5/04* (2013.01); *H04S 2400/03* (2013.01)

(58) Field of Classification Search
CPC ..... H04S 7/307; H04S 5/04; H04S 2400/03
See application file for complete search history.

(56) References Cited

U.S. PATENT DOCUMENTS 7,039,204 B2 5/2006 Baumgarte
2003/0235317 A1 12/2003 Baumgarte
(Continued)

FOREIGN PATENT DOCUMENTS

EP 2323130 A1 5/2011
JP 2004048741 A 2/2004
(Continued)

OTHER PUBLICATIONS

Faller, Christof , et al., "Binaural cue coding—part II: schemes and applications", IEEE Transactions on Speech and Audio Processing, IEEE Service Center, New York, NY, US, (Nov. 1, 2003), vol. 11, No. 6, doi:10.1109/TSA.2003.818108, ISSN 1063-6676, pp. 520-531, XP011104739, 2003.
(Continued)

*Primary Examiner* — Ping Lee
(74) *Attorney, Agent, or Firm* — Perkins Coie LLP; Michael A. Glenn

(57) ABSTRACT

A downmixer for providing a downmix signal on the basis of a plurality of input signals is configured to determine a magnitude value of a spectral domain value of the downmix signal on the basis of a loudness information of the input signals. The downmixer is configured to determine a phase value of the spectral domain value of the downmix signal and the downmixer is configured to apply the phase value in order to obtain a complex valued number representation of the spectral domain value of the downmix signal on the basis of the magnitude value of the spectral domain value of the downmix signal. An audio encoder uses such a downmixer. A method for downmixing and a computer program are also described.

37 Claims, 10 Drawing Sheets

(56) References Cited

U.S. PATENT DOCUMENTS

| | | | |
|---|---|---|---|
| 2007/0160218 | A1 | 7/2007 | Jakka et al. |
| 2012/0308018 | A1 | 12/2012 | Miao et al. |
| 2013/0262130 | A1 | 10/2013 | Ragot et al. |
| 2014/0222441 | A1 | 8/2014 | Kuntz et al. |
| 2015/0170657 | A1 | 6/2015 | Thompson et al. |
| 2018/0197554 | A1 | 7/2018 | Paulus et al. |
| 2019/0287542 | A1 | 9/2019 | Fueg et al. |

FOREIGN PATENT DOCUMENTS

| | | | |
|---|---|---|---|
| JP | 2013546013 | A | 12/2013 |
| JP | 2017501438 | A | 1/2017 |
| RU | 2409912 | C9 | 6/2011 |
| RU | 2016105741 | A | 8/2017 |
| RU | 2640650 | C2 | 1/2018 |
| RU | 2016125242 | A | 1/2018 |
| WO | 2006108573 | A1 | 10/2006 |
| WO | 2012006770 | A1 | 1/2012 |

OTHER PUBLICATIONS

Hoang, Thi Minh Nguyet , et al., "Parametric stereo extension of ITU-T G.722 based on a new downmixing scheme", 2010 IEEE International Workshop on Multimedia Signal Processing (MMSP '10), Saint Malo, France, Oct. 4-6, 2010, IEEE, IEEE, Piscataway, USA, ISBN 978-1-4244-8110-1, pp. 188-193, XP031830580, Oct. 2010.

Karapetyan, Aleksandr , et al., "Active Multichannel Audio Downmix", AES Convention 145; Oct. 2018, AES, 60 East 42nd Street, Room 2520 New York 10165-2520, USA, (Oct. 7, 2018), XP040699151, 2018.

THREE TYPES OF INTERFERENCES DURING A DOWNMIX PROCEDURE

SIGNAL FLOWCHART FOR LOUDNESS-PRESERVING DOWNMIX

LOUDNESS DOWNMIX WITH ADAPTIVE REFERENCE MAGNITUDE

DERIVATION OF THE CANCELLATION DEGREE
OF THE THREE INPUT SIGNALS IN THE COMPLEX PLANE

LOUDNESS DOWNMIX WITH ADAPTIVE PHASE

DOWNMIXER, AUDIO ENCODER, METHOD AND COMPUTER PROGRAM APPLYING A PHASE VALUE TO A MAGNITUDE VALUE

CROSS-REFERENCE TO RELATED APPLICATIONS

This application is a continuation of copending International Application No. PCT/EP2019/058713, filed Apr. 5, 2019, which is incorporated herein by reference in its entirety, and additionally claims priority from European Application No. 18166174.5, filed Apr. 6, 2018, which is also incorporated herein by reference in its entirety.

BACKGROUND OF THE INVENTION

Embodiments according to the invention are related to a downmixer for providing a downmix signal on the basis of a plurality of input signals.

Further embodiments according to the invention are related to an audio encoder for providing an encoded audio representation on the basis of a plurality of input audio signals.

Further embodiments according to the invention are related to a method for providing a downmix signal on the basis of a plurality of input signals.

Further embodiments according to an invention are related to a computer program.

In the field of audio signal processing, it is sometimes desirable to combine multiple audio signals into a single audio signal. For example, this may reduce the complexity for the audio encoding. Information about characteristics of the original audio signals and/or about characteristics of the downmix process may, for example, be included into an encoded audio representation, as well as the downmix signal itself (advantageously in an encoded form).

Downmixing is the process of converting, for example, a program with a multiple-channel configuration into a program with fewer channels. Regarding this issue, reference is made, for example, to the definition of "downmixing", which can be found in Wikipedia.

A special case is the binaural downmix, where several binaurally rendered signals (per ear) are mixed down into one channel. Conventionally, the N channels of a multichannel signal are merged together by a simple addition to form a M channel signal (wherein, typically, N>M).

In the following, some downmix issues will be described.

It has been found that, when mixing down several audio signals, unwanted interferences may be the result. It has also been found that interferences can be divided into three categories:

1. Two signals (wherein signals may, for example, be represented by vectors S, describing their magnitude (length) and phase (angle)) $S_1$ and $S_2$ do have at a certain point in time similar phase angles (see, for example, FIG. 4*a*), and then there are constructive interferences (for example, a magnitude addition with +6 dB instead of energy addition with +3 dB).
2. If both vectors point in different directions at a certain time (see, for example, FIG. 4*b*), then there is a partially destructive interference.
3. If both vectors do have similar magnitudes and an angular difference of approximately 180°, then there is a strong destructive interference or even a full cancellation (see, for example, FIG. 4*c*). In this case, the resulting vector does have an erroneous phase angle.

To conclude, three types of interferences have been discussed which may occur during a downmix procedure. These three types of interferences are illustrated in FIG. 4.

This problem occurs in broadband signals, as well as in individual frequency bands. In terms of audio quality, the first two types of interferences lead to unfavorable changes in the sound color, Flanger-like effects, partly reverberant impression, etc. The third type of interference, on the other hand, leads to the cancellation of signal components or can (perceptually) amplify the aforementioned artifacts.

It has been found that one approach for correcting unfavorable sound changes is carried out by modifying the spectrum of the mixed down signal. It has been found that through energy-preserving corrections in the individual frequency bands, the passive downmix is equalized in the spectral domain and the desired spectrum is (nearly) achieved. It has also been found that, advantageously, the energy values should be smoothened over time using this method. However, it has been found that, by smoothing, the resulting correction values become sluggish in reaction and can further amplify constructive or attenuate destructive interferences.

Such a concept could be summarized as energy-corrected downmix.

U.S. Pat. No. 7,039,204 B2 describes an equalization for audio mixing. During mixing an N-channel input signal to generate a M-channel output signal, the mixed channel signals are equalized (e.g., amplified) to maintain the overall energy/loudness level of the output signal substantially equal to the overall energy/loudness level of the input signal. In one embodiment, the N input channel signals are converted to the frequency domain on a frame-by-basis, and the overall spectral loudness of the N-channel input signal is estimated. After mixing the spectra for the N input channel signals (e.g., using weighted summation), the overall spectral loudness of the resulting M mixed channel signals is also estimated. A frequency-dependent gain factor, which is based on the two loudness estimates, is applied to the spectral components of the M mixed channel signals to generate M equalized mixed channel signals. The M-channel output signal is generated by converting the M equalized mixed channel signals to the time domain.

However, in view of the conventional concepts, there is a need for a concept for downmixing which provides for an improved tradeoff between audio quality and computational complexity.

SUMMARY OF THE INVENTION

An embodiment may have a downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to obtain a complex valued number representation of the spectral domain value of the downmix signal on the basis of the magnitude value of the spectral domain value of the downmix signal; wherein the downmixer is configured to determine a sum or a weighted sum of complex-valued spectral domain values of the input signals and to determine the phase value on the basis of a real part and an imaginary part of the sum or on the basis of a real part and an imaginary part of the weighted sum of spectral domain values of the input signals.

Another embodiment may have an audio encoder for providing an encoded audio representation on the basis of a plurality of input audio signals, wherein the audio encoder has an inventive downmixer as mentioned above, wherein the downmixer is configured to provide a downmix signal on the basis of spectral domain representations of the plurality of input audio signals, and wherein the audio encoder is configured to encode the downmix signal, in order to obtain the encoded audio representation.

Still another embodiment may have a method for providing a downmix signal on the basis of a plurality of input signals, wherein the method has determining a magnitude value of a spectral domain value of the downmix signal on the basis of a loudness information of the input signals, and wherein the method has determining a phase value of a spectral domain value of the downmix signal; and wherein the method has applying the phase value in order to obtain a complex number representation of the spectral domain value of the downmix signal on the basis of the magnitude value of the spectral domain value, wherein the method has determining a sum or a weighted sum of complex-valued spectral domain values of the input signals, and determining the phase value on the basis of a real part and an imaginary part of the sum or on the basis of a real part and an imaginary part of the weighted sum of spectral domain values of the input signals.

Another embodiment may have a non-transitory digital storage medium having stored thereon a computer program for performing the above inventive method for providing a downmix signal on the basis of a plurality of input signals, when said computer program is run by a computer.

Another embodiment may have a downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to obtain a complex valued number representation of the spectral domain value of the downmix signal on the basis of the magnitude value of the spectral domain value of the downmix signal; wherein the downmixer is configured to determine a cancellation degree information, and to consider the cancellation degree information in the determination of the magnitude value of a spectral domain value of the downmix signal, wherein the cancellation degree information describes a degree of constructive or destructive interference between spectral domain values of the input signals, and wherein the downmixer is configured to scale a magnitude value representing a sum of loudness values of the spectral domain values of the input signals in dependence on the cancellation degree information, to selectively reduce the magnitude value of the spectral domain value of the downmix signal when compared to a magnitude value representing a sum of loudness values of the spectral domain values of the input signals in case the cancellation degree information indicates a destructive interference.

Another embodiment may have a downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to obtain a complex valued number representation of the spectral domain value of the downmix signal on the basis of the magnitude value of the spectral domain value of the downmix signal; wherein the downmixer is configured to determine a cancellation degree information, and to consider the cancellation degree information in the determination of the magnitude value of a spectral domain value of the downmix signal, wherein the cancellation degree information describes a degree of constructive or destructive interference between spectral domain values of the input signals, and wherein the downmixer is configured to selectively reduce the magnitude value of the spectral domain value of the downmix signal when compared to a magnitude value representing a sum of loudness values of the spectral domain values of the input signals in case the cancellation degree information indicates a destructive interference; wherein the downmixer is configured to determine sums of components of the spectral domain values of the input signals having different orientations, and wherein the downmixer is configured to determine the cancellation degree information on the basis of the sums of components of the spectral domain values of the input signals having different orientations; wherein the downmixer is configured to select two of the determined sums, which are associated with orthogonal orientations, and which are larger than or equal to sums which are associated with opposite directions, as dominant sum values, and wherein the downmixer is configured to determine a scaling value, which causes a selective reduction of the magnitude value of the spectral domain value of the downmix signal on the basis of

- a non-signed ratio between a first non-dominant sum value, which is associated with an orientation opposite to an orientation of a first dominant sum value, and the first dominant sum value, and
- a non-signed ratio between a second non-dominant sum value, which is associated with an orientation opposite to an orientation of a second dominant sum value, and the second dominant sum value, such that increasing non-signed ratios between a non-dominant sum value and its associated dominant sum value result in a reduction of the magnitude value of the spectral domain value of the downmix signal.

Another embodiment may have a downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to obtain a complex valued number representation of the spectral domain value of the downmix signal on the basis of the magnitude value of the spectral domain value of the downmix signal; wherein the downmixer is configured to determine a cancellation degree information, and to consider the cancellation degree information in the determination of the magnitude value of a spectral domain value of the downmix signal, wherein the cancellation degree information describes a degree of constructive or destructive interference between spectral domain values of the input signals, and wherein the downmixer is configured to selectively reduce the magnitude value of the spectral domain value of the downmix signal when compared to a magnitude value representing a sum of loudness values of the spectral domain values of the input signals in case the cancellation degree information indicates a destructive interference; wherein the downmixer is configured to calculate the cancellation degree information Q according to the following equations:

if $sumIm^+ \geq |sumIm^-|$ and $sumRe^+ \geq |sumRe^-|$:

$$Q = \frac{\left(1 - \frac{|sumRe^-|}{sumRe^+}\right)(sumRe^+)^2 + \left(1 - \frac{|sumIm^-|}{sumIm^+}\right)(sumIm^+)^2}{(sumRe^+)^2 + (sumIm^+)^2}$$

if $sumIm^+ \geq |sumIm^-|$ and $sumRe^+ < |sumRe^-|$:

$$Q = \frac{\left(1 - \frac{sumRe^+}{|sumRe^-|}\right)(|sumRe^-|)^2 + \left(1 - \frac{|sumIm^-|}{sumIm^+}\right)(sumIm^+)^2}{(|sumRe^-|)^2 + (sumIm^+)^2}$$

if $sumIm^+ < |sumIm^-|$ and $sumRe^+ \geq |sumRe^-|$:

$$Q = \frac{\left(1 - \frac{|sumRe^-|}{sumRe^+}\right)(sumRe^+)^2 + \left(1 - \frac{sumIm^+}{|sumIm^-|}\right)(|sumIm^-|)^2}{(sumRe^+)^2 + (|sumIm^-|)^2}$$

if $sumIm^+ < |sumIm^-|$ and $sumRe^+ < |sumRe^-|$:

$$Q = \frac{\left(1 - \frac{sumRe^+}{|sumRe^-|}\right)(|sumRe^-|)^2 + \left(1 - \frac{sumIm^+}{|sumIm^-|}\right)(|sumIm^-|)^2}{(|sumRe^-|)^2 + (|sumIm^-|)^2}$$

wherein sumRe+ is a sum of positive real parts of complex-valued spectral domain values of the input audio signals; wherein sumRe− is a sum of negative real parts of complex-valued spectral domain values of the input audio signals; wherein sumlm+ is a sum of positive imaginary parts of complex-valued spectral domain values of the input audio signals; and wherein sumlm− is a sum of negative imaginary parts of complex-valued spectral domain values of the input audio signals.

Another embodiment may have a downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to obtain a complex valued number representation of the spectral domain value of the downmix signal on the basis of the magnitude value of the spectral domain value of the downmix signal; wherein the downmixer is configured to determine a reference magnitude value on the basis of a plurality of input signals; and wherein the downmixer is configured to scale the reference magnitude value, which is unaffected by constructive and destructive interference of the input signals, to determine the magnitude value of the spectral domain value of the downmix signal such that the magnitude value is selectively reduced with respect to a reference value, which corresponds to a sum loudness of spectral domain values of the input signals, at time instances at which a cancellation degree information determined by the downmixer indicates a comparatively large destructive interference between the input signals, and such that the magnitude value is selectively increased with respect to the reference value at time instances at which the cancellation degree information indicates a comparatively small destructive interference between the input signals.

Still another embodiment may have a downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to obtain a complex valued number representation of the spectral domain value of the downmix signal on the basis of the magnitude value of the spectral domain value of the downmix signal; wherein the downmixer is configured to obtain an updated smoothened cancellation degree value Qsmooth(t) on the basis of a previous smoothened cancellation degree value Qsmooth(t−1) and on the basis of an instant cancellation degree value Q(t) according to $$Q_{smooth}(t)=p*Q_{smooth}(t-1)+(p-1)*Q(t)$$

wherein p is a constant with 0<p<1;

and wherein the downmixer is configured to obtain a mapped cancellation degree value Qmapped according to $$Q_{mapped}(t)=(Q(t)+1)^{(Q_{smooth}(t)^{T})}-1$$

wherein T is a constant with 0<T<1;

wherein Q(t) is in a range between 0 and 1 and takes a value of 0 for a comparatively large destructive interference between the input signals and takes a value of 1 for a comparatively small destructive interference between the input signals; wherein the downmixer is configured to scale a reference magnitude value using the mapped cancellation degree value, to obtain the magnitude value.

Another embodiment may have a downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to obtain a complex valued number representation of the spectral domain value of the downmix signal on the basis of the magnitude value of the spectral domain value of the downmix signal; wherein the downmixer is configured to obtain an updated smoothened cancellation degree value Qsmooth(t) on the basis of a previous smoothened cancellation degree value Qsmooth(t−1) and on the basis of an instant cancellation degree value Q(t) according to $$Q_{smooth}(t)=p*Q_{smooth}(t-1)+(p-1)*Q(t)$$

wherein p is a constant with 0<=p<=1;

and wherein the downmixer is configured to obtain a mapped cancellation degree value Qmapped according to $$m_{slope}(t)=\max\{G*Q_{smooth}(t)-1,1\}$$

$$Q_{mapped}(t)=\min\{m_{slope}(t)*Q(t),1\}$$

wherein G is a predetermined value or a constant value between 0.5 and 20 or between 1 and 10; wherein $m_{slope}(t)$ is an auxiliary variable; wherein max{ } is a maximum operator; wherein min{ } is a minimum operator; wherein Q(t) is in a range between 0 and 1 and takes a value of 0 for a comparatively large destructive interference between the input signals and takes a value of 1 for a comparatively small destructive interference between the input signals; wherein the downmixer is configured to scale a reference magnitude value using the mapped cancellation degree value, to obtain the magnitude value.

Another embodiment may have a downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to obtain a complex valued number representation of the spectral domain value of the downmix signal on the basis of the magnitude value of the spectral domain value of the downmix signal; wherein the downmixer is configured to determine a weighted sum of spectral domain values of the input signals and to determine the phase value on the basis of the weighted sum of spectral domain values of the input signals, wherein the downmixer is configured to weight spectral domain values of the input signals in such a way to avoid destructive interference which is larger than a predetermined interference level, to obtain the weighted sum; wherein the downmixer is configured to determine loudness values of spectral domain values of the input signals, and wherein the downmixer is configured to derive a sum loudness value associated with the spectral domain value of the downmix signal on the basis of the loudness values of the spectral domain values of the input signals; and wherein the downmixer is configured to derive the magnitude value of the spectral domain value of the downmix signal from the sum loudness value.

Another embodiment may have a downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to obtain a complex valued number representation of the spectral domain value of the downmix signal on the basis of the magnitude value of the spectral domain value of the downmix signal; wherein the downmixer is configured to determine a weighted sum of spectral domain values of the input signals and to determine the phase value on the basis of the weighted sum of spectral domain values of the input signals, wherein the downmixer is configured to weight spectral domain values of the input signals in dependence on a time-averaged intensity of the respective spectral bin in different input signals using weighting values, to obtain the weighted sum; wherein the downmixer is configured to determine loudness values of spectral domain values of the input signals, and wherein the downmixer is configured to derive a sum loudness value associated with the spectral domain value of the downmix signal on the basis of the loudness values of the spectral domain values of the input signals; and wherein the downmixer is configured to derive the magnitude value of the spectral domain value of the downmix signal from the sum loudness value; wherein the downmixer is configured to form an average over spectral domain values of a plurality of spectral bins of a first of the input signals which are associated with the same frequency and which are associated with subsequent times, to obtain a first of the weighting values for the first input signal, and wherein the downmixer is configured to form an average over spectral domain values of a plurality of spectral bins of a second of the input signals which are associated with the same frequency and which are associated with subsequent times, to obtain a second of the weighting values for the second input signal.

Another embodiment may have a method for providing a downmix signal on the basis of a plurality of input signals, wherein the method has determining a magnitude value of a spectral domain value of the downmix signal on the basis of a loudness information of the input signals, and wherein the method has determining a phase value of the spectral domain value of the downmix signal; and wherein the method has applying the phase value in order to obtain a complex valued number representation of the spectral domain value of the downmix signal on the basis of the magnitude value of the spectral domain value of the downmix signal; wherein the method has determining a cancellation degree information, and considering the cancellation degree information in the determination of the magnitude value of a spectral domain value of the downmix signal, wherein the cancellation degree information describes a degree of constructive or destructive interference between spectral domain values of the input signals, and wherein the method has scaling a magnitude value representing a sum of loudness values of the spectral domain values of the input signals in dependence on the cancellation degree information, to selectively reduce the magnitude value of the spectral domain value of the downmix signal when compared to a magnitude value representing a sum of loudness values of the spectral domain values of the input signals in case the cancellation degree information indicates a destructive interference.

Another embodiment may have a method for providing a downmix signal on the basis of a plurality of input signals, wherein the method has determining a magnitude value of a spectral domain value of the downmix signal on the basis of a loudness information of the input signals, and wherein the method has determining a phase value of the spectral domain value of the downmix signal; and wherein the method has applying the phase value in order to obtain a complex valued number representation of the spectral domain value of the downmix signal on the basis of the magnitude value of the spectral domain value of the downmix signal; wherein the method has determining a cancellation degree information, and considering the cancellation degree information in the determination of the magnitude value of a spectral domain value of the downmix signal, wherein the cancellation degree information describes a degree of constructive or destructive interference between spectral domain values of the input signals, and wherein the method has selectively reducing the magnitude value of the spectral domain value of the downmix signal when compared to a magnitude value representing a sum of loudness values of the spectral domain values of the input signals in case the cancellation degree information indicates a destructive interference; wherein the method has determining sums of components of the spectral domain values of the input signals having different orientations, and wherein the method has determining the cancellation degree information on the basis of the sums of components of the spectral domain values of the input signals having different orientations; wherein the method has selecting two of the determined sums, which are associated with orthogonal orientations, and which are larger than or equal to sums which are associated with opposite directions, as dominant sum values, and wherein the method has determining a scaling value, which causes a selective reduction of the magnitude value of the spectral domain value of the downmix signal on the basis of a non-signed ratio between a first non-dominant sum value, which is associated with an orientation opposite to an orientation of a first dominant sum value, and the first dominant sum value, and a non-signed ratio between a second non-dominant sum value, which is associated with an orientation opposite to an orientation of a second dominant sum value, and the second dominant sum value, such that increasing non-signed ratios between a non-dominant sum value and its associated dominant sum value result in a reduction of the magnitude value of the spectral domain value of the downmix signal.

Another embodiment may have a method for providing a downmix signal on the basis of a plurality of input signals, wherein the method has determining a magnitude value of a spectral domain value of the downmix signal on the basis of a loudness information of the input signals, and wherein the method has determining a phase value of the spectral domain value of the downmix signal; and wherein the method has applying the phase value in order to obtain a complex valued number representation of the spectral domain value of the downmix signal on the basis of the magnitude value of the spectral domain value of the downmix signal; wherein the method has determining a cancellation degree information, and considering the cancellation degree information in the determination of the magnitude value of a spectral domain value of the downmix signal, wherein the cancellation degree information describes a degree of constructive or destructive interference between spectral domain values of the input signals, and wherein the method has selectively reducing the magnitude value of the spectral domain value of the downmix signal when compared to a magnitude value representing a sum of loudness values of the spectral domain values of the input signals in case the cancellation degree information indicates a destructive interference; wherein the method has calculating the cancellation degree information Q according to the following equations:

if $sumIm^+ \geq |sumIm^-|$ and $sumRe^+ \geq |sumRe^-|$:

$$Q = \frac{\left(1 - \frac{|sumRe^-|}{sumRe^+}\right)(sumRe^+)^2 + \left(1 - \frac{|sumIm^-|}{sumIm^+}\right)(sumIm^+)^2}{(sumRe^+)^2 + (sumIm^+)^2}$$

if $sumIm^+ \geq |sumIm^-|$ and $sumRe^+ < |sumRe^-|$:

$$Q = \frac{\left(1 - \frac{sumRe^+}{|sumRe^-|}\right)(|sumRe^-|)^2 + \left(1 - \frac{|sumIm^-|}{sumIm^+}\right)(sumIm^+)^2}{(|sumRe^-|)^2 + (sumIm^+)^2}$$

if $sumIm^+ < |sumIm^-|$ and $sumRe^+ \geq |sumRe^-|$:

$$Q = \frac{\left(1 - \frac{|sumRe^-|}{sumRe^+}\right)(sumRe^+)^2 + \left(1 - \frac{sumIm^+}{|sumIm^-|}\right)(|sumIm^-|)^2}{(sumRe^+)^2 + (|sumIm^-|)^2}$$

if $sumIm^+ < |sumIm^-|$ and

-continued $sumRe^+ < |sumRe^-|$:

$$Q = \frac{\left(1 - \frac{sumRe^+}{|sumRe^-|}\right)(|sumRe^-|)^2 + \left(1 - \frac{sumIm^+}{|sumIm^-|}\right)(|sumIm^-|)^2}{(|sumRe^-|)^2 + (|sumIm^-|)^2}$$

wherein sumRe+ is a sum of positive real parts of complex-valued spectral domain values of the input audio signals; wherein sumRe− is a sum of negative real parts of complex-valued spectral domain values of the input audio signals; wherein sumlm+ is a sum of positive imaginary parts of complex-valued spectral domain values of the input audio signals; and wherein sumlm− is a sum of negative imaginary parts of complex-valued spectral domain values of the input audio signals.

Another embodiment may have a method for providing a downmix signal on the basis of a plurality of input signals, wherein the method has determining a magnitude value of a spectral domain value of the downmix signal on the basis of a loudness information of the input signals, and wherein the method has determining a phase value of the spectral domain value of the downmix signal; and wherein the method has applying the phase value in order to obtain a complex valued number representation of the spectral domain value of the downmix signal on the basis of the magnitude value of the spectral domain value of the downmix signal; wherein the method has determining a reference magnitude value on the basis of a plurality of input signals; and wherein the method has scaling the reference magnitude value, which is unaffected by constructive and destructive interference of the input signals, to determine the magnitude value of the spectral domain value of the downmix signal such that the magnitude value is selectively reduced with respect to a reference value, which corresponds to a sum loudness of spectral domain values of the input signals, at time instances at which a cancellation degree information determined by the downmixer indicates a comparatively large destructive interference between the input signals, and such that the magnitude value is selectively increased with respect to the reference value at time instances at which the cancellation degree information indicates a comparatively small destructive interference between the input signals.

Still another embodiment may have a method for providing a downmix signal on the basis of a plurality of input signals, wherein the method has determining a magnitude value of a spectral domain value of the downmix signal on the basis of a loudness information of the input signals, and wherein the method has determining a phase value of the spectral domain value of the downmix signal; and wherein the method has applying the phase value in order to obtain a complex valued number representation of the spectral domain value of the downmix signal on the basis of the magnitude value of the spectral domain value of the downmix signal; wherein the method has obtaining an updated smoothened cancellation degree value Qsmooth(t) on the basis of a previous smoothened cancellation degree value Qsmooth(t−1) and on the basis of an instant cancellation degree value Q(t) according to $$Q_{smooth}(t)=p*Q_{smooth}(t-1)+(p-1)*Q(t)$$

wherein p is a constant with 0<p<1;

and wherein the method has obtaining a mapped cancellation degree value Qmapped according to $$Q_{mapped}(t)=(Q(t)+1)^{(Q_{smooth}(t)^T)}-1$$

wherein T is a constant with 0<T<1; wherein Q(t) is in a range between 0 and 1 and takes a value of 0 for a comparatively large destructive interference between the input signals and takes a value of 1 for a comparatively small destructive interference between the input signals; wherein the method has scaling a reference magnitude value using the mapped cancellation degree value, to obtain the magnitude value.

Another embodiment may have a method for providing a downmix signal on the basis of a plurality of input signals, wherein the method has determining a magnitude value of a spectral domain value of the downmix signal on the basis of a loudness information of the input signals, and wherein the method has determining a phase value of the spectral domain value of the downmix signal; and wherein the method has applying the phase value in order to obtain a complex valued number representation of the spectral domain value of the downmix signal on the basis of the magnitude value of the spectral domain value of the downmix signal; wherein the method has obtaining an updated smoothened cancellation degree value Qsmooth(t) on the basis of a previous smoothened cancellation degree value Qsmooth(t−1) and on the basis of an instant cancellation degree value Q(t) according to $$Q_{smooth}(t)=p*Q_{smooth}(t-1)+(p-1)*Q(t)$$

wherein p is a constant with 0<=p<=1;

and wherein the method has obtaining a mapped cancellation degree value Qmapped according to $$m_{slope}(t)=\max\{G*Q_{smooth}(t)-1,1\}$$

$$Q_{mapped}(t)=\min\{m_{slope}(t)*Q(t),1\}$$

wherein G is a predetermined value or a constant value between 0.5 and 20 or between 1 and 10; wherein $m_{slope}(t)$ is an auxiliary variable; wherein max{ } is a maximum operator; wherein min{ } is a minimum operator; wherein Q(t) is in a range between 0 and 1 and takes a value of 0 for a comparatively large destructive interference between the input signals and takes a value of 1 for a comparatively small destructive interference between the input signals; wherein the method has scaling a reference magnitude value using the mapped cancellation degree value, to obtain the magnitude value.

Another embodiment may have a method for providing a downmix signal on the basis of a plurality of input signals, wherein the method has determining a magnitude value of a spectral domain value of the downmix signal on the basis of a loudness information of the input signals, and wherein the method has determining a phase value of the spectral domain value of the downmix signal; and wherein the method has applying the phase value in order to obtain a complex valued number representation of the spectral domain value of the downmix signal on the basis of the magnitude value of the spectral domain value of the downmix signal; wherein the method has determining a weighted sum of spectral domain values of the input signals and determining the phase value on the basis of the weighted sum of spectral domain values of the input signals, wherein the method has weighting spectral domain values of the input signals in such a way to avoid destructive interference which is larger than a predetermined interference level, to obtain the weighted sum; wherein the method has determining loudness values of spectral domain values of the input signals, and wherein the method has deriving a sum loudness value associated with the spectral domain value of the downmix signal on the basis of the loudness values of the spectral domain values of the input signals; and wherein the method has deriving the magnitude value of the spectral domain value of the downmix signal from the sum loudness value.

Another embodiment may have a method for providing a downmix signal on the basis of a plurality of input signals, wherein the method has determining a magnitude value of a spectral domain value of the downmix signal on the basis of a loudness information of the input signals, and wherein the method has determining a phase value of the spectral domain value of the downmix signal; and wherein the method has applying the phase value in order to obtain a complex valued number representation of the spectral domain value of the downmix signal on the basis of the magnitude value of the spectral domain value of the downmix signal; wherein the method has determining a weighted sum of spectral domain values of the input signals and determining the phase value on the basis of the weighted sum of spectral domain values of the input signals, wherein the method has weighting spectral domain values of the input signals in dependence on a time-averaged intensity of the respective spectral bin in different input signals using weighting values, to obtain the weighted sum; wherein the method has determining loudness values of spectral domain values of the input signals, and wherein the method has deriving a sum loudness value associated with the spectral domain value of the downmix signal on the basis of the loudness values of the spectral domain values of the input signals; and wherein the method has deriving the magnitude value of the spectral domain value of the downmix signal from the sum loudness value; wherein the method has forming an average over spectral domain values of a plurality of spectral bins of a first of the input signals which are associated with the same frequency and which are associated with subsequent times, to obtain a first of the weighting values for the first input signal, and wherein the method has forming an average over spectral domain values of a plurality of spectral bins of a second of the input signals which are associated with the same frequency and which are associated with subsequent times, to obtain a second of the weighting values for the second input signal.

Still another embodiment may have a non-transitory digital storage medium having stored thereon a computer program for performing any of the above inventive methods for providing a downmix signal on the basis of a plurality of input signals, when said computer program is run by a computer.

An embodiment according to the invention creates a downmixer for providing a downmix signal on the basis of a plurality of input signals (which may, for example, be complex-valued and which may, for example, be input audio signals). The downmixer is configured to determine (for example, to compute or estimate) a magnitude value of a spectral domain value of the downmixed signal (for example, for a given spectral bin) on the basis of a loudness information of the input signals (for example, on the basis of loudness values associated with the given spectral bin of the input signals). The downmixer is configured to determine a phase value (which may, for example, be a scalar value) of the spectral domain value of the downmix signal (for example, for the given spectral bin). For example, the downmixer may be configured to determine the phase value independently from the determination of the magnitude value. The downmixer is configured to apply the phase value in order to obtain a complex-valued number representation of the spectral domain value of the downmix signal (for example, for the given spectral bin) on the basis of the magnitude value of the spectral domain value of the downmix signal.

This embodiment according to the invention is based on the idea that a good tradeoff between computational complexity and audio quality can be achieved by computing the magnitude value of a spectral domain value of the downmix signal, which is a scalar value, and by applying a phase value, which typically is a scalar value that is computed separately from the magnitude value, in a subsequent step. Accordingly, most of the processing steps can operate on scalar values, and a complex-valued number representation of spectral domain values of the downmix signals are only generated at a late (or final) stage of the computation.

Moreover, it has been found that the determination of a scalar magnitude value is possible with good accuracy on the basis of loudness information of the input signals. By using the loudness information of the input signals to obtain the magnitude value, it can be avoided that the magnitude value is strongly affected by destructive interference. This is due to the fact that the loudness information of the input signals is typically not affected by destructive interference, such that a mapping of the loudness information onto the magnitude value typically results in numerically stable solutions.

In other words, by determining the magnitude value of the spectral domain value primarily on the basis of the loudness information of the input signals (with a possible, optional correction after the mapping of the loudness information onto the magnitude value, to consider cancellation effects), numeric instabilities and artifacts which could be caused by adding complex-valued numbers and by a subsequent scaling can be avoided.

Moreover, by considering the loudness information of the input signals when determining the magnitude value, a 6 dB signal amplification, which could occur in the case of constructive interference, and which would typically be perceived as an artifact, can be avoided. Rather, by considering the loudness information of the input signals, it can be achieved that the downmix signal is better adapted to the perceived loudness when compared to cases in which there is simply an addition of complex values representing input signals.

Furthermore, it has been found that a separate phase calculation, which is separate from the determination of the magnitude value, provides a high degree of flexibility. The phase calculation can be made with good accuracy, wherein it is possible to apply corrections to determine phase values in the case of destructive interference. Since the phase value is typically a scalar value, which is only applied when the magnitude value has been determined, a computational effort for determining and correcting the phase value is particularly small.

To conclude, it has been found that a good tradeoff between computational efficiency and a hearing impression can be achieved by separately processing the magnitude value and the phase value and by only combining these values, to obtain a complex-valued number representation of the spectral domain value of the downmix signal, at the end of the processing chain (i.e., at the end of the downmixing).

In an embodiment, the downmixer is configured to determine the phase value of the spectral domain value of the downmix signal independently from the determination of the magnitude value of the spectral domain value of the downmix signal. Such a separate processing and determination of the magnitude value and of the phase value has been shown to be computationally efficient. Also, there is no uncontrollable impact of destructive interference in a processing path for determining the magnitude value.

In an embodiment, the downmixer is configured to determine loudness values of spectral domain values of the input signals. The downmixer is configured to derive a sum loudness value associated with the spectral domain value of the downmix signal on the basis of the loudness values of the spectral domain values of the input signals. The downmixer is configured to derive the magnitude value (for example, an amplitude value) of the spectral domain value of the downmix signal from the sum loudness value. Accordingly, the magnitude value well represents a perceived loudness. However, by considering the sum loudness, and by converting this sum loudness value into the magnitude value, it can be achieved that the magnitude value (for example, an amplitude value) of the spectral domain value of the downmix signal does not comprise excessive loudness in the case that input signals show constructive interference. In this case, there is just an addition of the loudness but not a quadratic increase of the loudness, which brings along a reasonable hearing impression. On the other hand, there is also no destructive interference, such that there are no "deep valleys" of the magnitude value, even in the case that there is destructive interference between the input signals. Accordingly, the derived magnitude value is well-suitable for a further processing. If it desired, it is easily possible to attenuate the magnitude value or even to increase the magnitude value without any numerical problems. In particular, deriving this magnitude value on the basis of the loudness values has the advantage that the magnitude value is always within a reasonable range of values, because both extremely small values are avoided (by considering a sum loudness value) and also excessively large values are avoided (by avoiding a direct addition of amplitudes). Thus, such a processing is of big advantage.

In an embodiment, the downmixer is configured to determine a sum or a weighted sum of spectral domain values of the input signals and to determine the phase value on the basis of the sum or on the basis of the weighted sum of spectral domain values of the input signals. By using such a computation of the phase value, a correct and reliable phase value can be obtained under many circumstances (even though there may be some errors in the case of strong destructive interference).

In an embodiment, the downmixer is configured to use the magnitude value of the spectral domain value of the downmix signal as an absolute value of a polar representation of the spectral domain value of the downmix signal and to use the phase value as a phase value of the polar representation of the spectral domain value of the downmix signal. Furthermore, the downmixer is configured to obtain a Cartesian complex-valued representation of the spectral domain value of the downmix signal on the basis of the polar representation.

Accordingly, a Cartesian complex-valued representation of the spectral domain value is obtained at a comparatively late stage of the processing, while the preceding processing stages separately determine the absolute value and the phase value. It has been found that such a procedure is advantageous, since handling of the full complex values can lead to undesirable artifacts depending on the phase relationship between the input signals. Rather, only combining the absolute value and the phase value a late stage of the processing (or even as a final stage of the determination of the downmix signal) avoids such artifacts. Also, the individual processing of the absolute value and of the phase value is computationally easier than a handling of complex values in multiple processing stages.

In an embodiment, the downmixer is configured to determine (for example, calculate) a cancellation degree information (for example, Q), and to consider the cancellation degree information in the determination of the magnitude value (for example, $M_R$,$M_R^{Mod}$) of a spectral domain value of the downmix signal. For example, the cancellation degree information describes (or quantiviely describes) a degree of constructive or destructive interference between spectral domain values (for example, associated with the same spectral bin) of the input signals. Moreover, the downmixer is configured to selectively reduce (for example, attenuate) the magnitude value (for example, $M_R^{Mod}$) of the spectral domain value of the downmix signal when compared to (or with respect to) a magnitude value (for example, $M_R$), or when compared to (or with respect to) a "reference magnitude" representing a sum of loudness values of the spectral domain values of the input signal in case the cancellation degree information indicates a destructive interference (wherein, for example, the reduction of the magnitude value may vary continuously in dependence on the cancellation degree information). It has been found that a reduction of the magnitude value of the spectral domain value is recommendable when a strong destructive interference is found, because the phase value is typically unreliable in this case. In other words, the presence of strong destructive interference typically causes the phase value to be unreliable, or to change rapidly over a large angle range. In such cases, the reduction of the magnitude value of the spectral domain value of the downmix signal helps to reduce artifacts. However, it has been found that it is better to reduce the magnitude value of the spectral domain value of the downmix signal in a well-controlled manner when compared to simply adding complex valued representations of spectral domain values of the input signals.

In other words, the concept allows for a particularly good tradeoff between computational efficiency and a reduction of an impact of (strong) destructive interference.

In an embodiment, the downmixer is configured to determine sums (for example, sumlm+, sumlm−, sumRe+, sumRe−) of components of the spectral domain values of the input signals having (for example, four) different orientations (for example, components having orientation in a direction of the positive imaginary axes, components having orientation in a direction of the negative imaginary axes, components having orientation in a direction of the positive real axis and components having orientation in a direction of the negative real axis; alternatively, components have orientation in a first direction, which may be determined by a vector of the sum of spectral domain values of the input signals, a second direction which is orthogonal to the first direction, a third direction which is opposite to the first direction, and a fourth direction which is opposite to the second direction). Moreover, the downmixer is configured to determine the cancellation degree information on the basis of the sums (for example, sumlm+, sumlm−, sumRe+, sumRe−) of components of the spectral domain values of the input signals having different orientations.

It has been found that evaluating sums of components of the spectral domain values of the input signals having different orientations allows to efficiently judge an expected degree of cancellation. For example, if the components all have the same orientation (for example, all have a positive imaginary part and a positive real part), it can be expected that there is no strong cancellation. On the other hand, if the sums of components in opposite directions are similar or even identical, it can be concluded that there is a high degree of cancellation. In other words, by comparing sums of components in different orientations or directions, it is possible to efficiently and reliably conclude to a degree of cancellation. Accordingly, it is possible to adapt the magnitude value of the spectral domain value of the downmix signal when excessive cancellation is expected (or, equivalently, when it is expected that the phase information is unreliable).

In an embodiment, the downmixer is configured to select two of the determined sums (for example, sumlm+, and sumRe+), which are associated with orthogonal orientations or directions (for example, along the positive imaginary axis and along the positive real axis) and which are larger than or equal to sums which are associated with opposite orientations or directions (for example, sumlm−, and sumRe−) as dominant sum values (e.g. sumlm+ and sumRe+). For example, the downmixer is configured to determine, for two orientations, which of the determined sums have the largest magnitude and to select these sums as the "dominant sum values". Moreover, the downmixer is configured to determine a scaling value (for example, Q or $Q_{mapped}$), which causes a selective reduction of the magnitude value (for example, $M_R^{Mod}$) of the spectral domain value of the downmix signal on the basis of a non-signed ratio (i.e., a ratio where the sign is not considered, or a ratio of absolute values, or an absolute value of a ratio) between a first non-dominant sum value (for example, sumRe−), which is associated with a direction or an orientation opposite to an orientation of a first dominant sum value (for example sumRe+), and the first dominant sum value (for example, sumRe+), and also on the basis of a non-signed ratio (for example, a ratio where the sign is not considered, or a ratio of absolute values, or an absolute value of a ratio) between a second non-dominant sum value (for example, sumlm−), which is associated with an orientation (or direction) opposite to an orientation (or direction) of a second dominant sum value (for example, sumlm+), and the second dominant sum value (for example, sumlm+), such that an increase of non-signed ratios (for example, |sumRe−|/sumRe+ and |sumlm−|/sumlm+) between a non-dominant sum value and its associated dominant sum value results in a reduction of the magnitude value (for example, $M_R^{Mod}$) of the spectral domain value of the downmix signal (for example, in a reduction of the scaling value Q). This embodiment is based on the idea that a ratio between sum values which are associated with opposite directions provides reliable information about a degree of negative (destructive) interference. For example, if the first non-dominant sum value is significantly smaller than the first dominant sum value, it can be concluded that there is no or only small cancellation between the first direction (associated to the first dominant sum) and the third direction (associated with the first non-dominant sum). Similarly, if the non-signed ratio (i.e., a ratio which does not consider the sign) between the first non-dominant sum value and its associated first dominant sum value becomes large (for example, close to one), it can be concluded that there is a comparatively strong cancellation between the first direction (to which the first dominant sum value is associated) and the third direction (to which the first non-dominant sum value is associated). To conclude, the non-dominant sum values and the dominant sum values can be efficiently used to recognize a cancellation between input signals, and can therefore efficiently be used in order to control a reduction of the magnitude value of the spectral domain value of the downmix signal.

In an embodiment, the downmixer is configured to calculate the cancellation degree information Q according to the equation mentioned herein. In this case, sumRe+ is a sum of positive real parts of complex-valued spectral domain values of the input audio signals (for example, in a spectral bin under consideration, wherein all complex-valued spectral domain values having a positive real part are considered). sumRe− is a sum of negative real parts of complex-valued spectral domain values of the input audio signals (for example, in a spectral bin under consideration) wherein all complex-valued spectral domain values having a negative real part are considered. sumIm+ may be a sum of positive imaginary parts of complex-valued spectral domain values of the input audio signals (for example, in a spectral bin under consideration) wherein all complex-valued spectral domain values having a positive imaginary part are considered). sumIm− is a sum of negative imaginary parts of complex-valued spectral domain values of the input audio signal (for example, in a spectral bin under consideration) wherein all complex-valued spectral domain values having a negative imaginary part are considered. Accordingly, the cancellation degree information Q can be computed in an efficient manner in accordance with the considerations mentioned above.

In an embodiment, the downmixer is configured to determine the magnitude value (for example, $M_R^{Mod}$) of the spectral domain value of the downmix signal, such that the magnitude value (for example, $M_R^{Mod}$) is selectively reduced with respect to a reference value (for example, $M_R$), which corresponds to a sum loudness of spectral domain values of the input signals, at time instances at which a cancellation degree information (for example, Q) determined by the downmixer indicates a comparatively large destructive interference between the input signals (for example, in the spectral bin under consideration), and such that the magnitude value is selectively increased with respect to the reference value (for example, $M_R$) at time instances at which the cancellation degree information (for example, Q) indicates a comparatively small destructive interference between the input signals. By selectively decreasing the magnitude value of the spectral domain value of the downmix signal at time instances at which the cancellation degree information indicates a comparatively large destructive interference, distortions which could be caused by erroneous phase values or by a fast change of the phase values can be avoided. On the other hand, by selectively increasing the magnitude value of the spectral domain value of the downmix signal at time instance at which the cancellation degree information indicates a comparatively small destructive interference between the input signals, energy losses, which are caused by the reduction of the magnitude value, can be compensated at least partially. Thus, an overall perceived loudness can be maintained. The selective reduction of the magnitude of the spectral domain value of the downmix signal at some time instances (where there is high destructive interference) is (at least partially) compensated by a selective increase of the magnitude of the spectral domain value of the downmix signal at other instances of time when there is no high risk of distortions. Accordingly, energy losses can be at least partially compensated and a good hearing impression of the downmix signal can be achieved.

In an embodiment, the downmixer is configured to track the cancellation degree information (for example, Q(t)) over time and to determine, in dependence on a history of the cancellation degree information, by how much the magnitude value (for example, $M_R^{Mod}$) is selectively increased with respect to the reference magnitude value (for example, $M_R$) at time instances at which the cancellation degree information (for example, Q) indicates a comparatively small destructive interference between the input signals. For example, the selective increase of the magnitude value with respect to the reference magnitude value can be determined such that the magnitude value is increased by a comparatively large value if there has been a comparatively strong reduction of the magnitude value previously (for example, in a time average) and such that the magnitude value is increased by a comparatively smaller value if there has been a comparatively smaller reduction of the magnitude value previously (for example, in a time average). In other words, the degree of the selective increase of the magnitude value with respect to the reference value can be determined such that a loss of energy due to the selective reduction of the magnitude value at time instances at which the cancellation degree information indicates a comparatively large destructive interference between the input signals is at least partially compensated by the selective increase of the magnitude value at time instances at which the cancellation degree information indicates a comparatively small destructive interference. Thus, energy loss, which would be caused by the reduction of the magnitude value at time instances at which destructive interference occurs, can be at least partially compensated, wherein the history of the cancellation degree information provides a reliable information how much compensation is appropriate.

In an embodiment, the downmixer is configured to obtain a temporarily smoothened cancellation degree information on the basis of an instant cancellation degree information using an infinite-impulse response smoothing operation or using a sliding average smoothing operation, in order to track the cancellation degree information. It has been found that such operations are well-adapted for tracking the cancellation degree information and bring along reliable results.

In an embodiment, the downmixer is configured to map an instant cancellation degree value (for example, Q(t)) onto a mapped cancellation degree value (for example, $Q_{mapped}$) (which may, for example, determine by how much the magnitude value $M_R^{Mod}$ is selectively increased with respect to the reference value $M_R$ at time instances at which the cancellation degree information Q indicates a comparatively small destructive interference between the input signals) in dependence on the temporally smoothened cancellation degree information, such that a value of the temporally smoothened cancellation degree information indicating a (past/previous) reduction of the magnitude value results in an increase of the (current) mapped cancellation degree value over the instant (current) cancellation degree value (at least for an instant cancellation degree value indicating a comparatively small destructive interference between the input signals). Accordingly, it is effectively possible to derive a mapped cancellation degree value which is well-adapted to a previous development of the cancellation degree information.

In an embodiment, the downmixer is configured to obtain an updated smoothened cancellation degree value $Q_{smooth}(t)$ on the basis of a previous smoothened cancellation degree value $Q_{smooth}(t-1)$ and on the basis of an instant (current) cancellation degree value Q(t) according the equation described herein, wherein p may be a constant with $0<p<1$. The downmixer may also be configured to obtain a mapped cancellation degree value $Q_{mapped}(t)$ according to the equation described herein, wherein T is a constant with $0<T<1$. Advantageously, the relationship $0.3<=T<=0.8$ may hold. Furthermore, it may be assumed that Q(t) is in a range between 0 and 1 and takes a value of 0 for a comparatively large destructive interference between the input signals and takes a value of 1 for a comparatively small destructive interference between the input signals. it has been shown that such a computation of the mapped cancellation degree value brings along good results while keeping the computational complexity reasonably small.

In an embodiment, the downmixer is configured to scale a magnitude value (for example, a "reference value", which may be equal to $M_R$) which corresponds to a sum loudness of spectral domain values of the input signals, using a cancellation degree value (for example, $Q_{mapped}$), to obtain the magnitude value of the spectral domain value of the downmix signal. Accordingly, the spectral domain value of the downmix signal may be reduced (for example, with respect to the reference value) at a time at which there is a high risk of interference, and may be increased (for example, with respect to the reference value) at times at which there is a low risk of interference. Accordingly, excessive artifacts can be avoided at times at which there is a high likelihood of destructive interference, and energy losses can be compensated at times at which there is a low probability of destructive interference. On the other hand, the magnitude value of the spectral domain value of the downmix signal may be kept within a reasonable range, such that excessive loudness exaggeration in the case of constructive interference is also avoided. Furthermore, the concepts described herein avoid numeric problems, because it is avoided to strongly "up-scale" values which are close to zero (for example, due to destructive interference).

In an embodiment, the downmixer is configured to determine a weighted sum of spectral domain values of the input signals, and to determine the phase value of on the basis of the weighted sum of spectral domain values of the input signal. For example, the downmixer is configured to weight spectral domain values of the input signal in such a way to avoid destructive interference which is larger than a predetermined interference level. In other words, when determining the phase value, a weighting may be introduced in order to avoid excessive destructive interference. For example, by using such a weighting, a reliability of the phase values may be increased (for example, by putting a relatively increased weight onto spectral domain values which had comparatively large magnitude in the past). Thus, a quality of the phase determination can be improved.

In an embodiment, the downmixer is configured to determine a weighted sum of spectral domain values of the input signals and to determine the phase value on the basis of the weighted sum of the spectral domain values of the input signals. The downmixer is configured to weight spectral domain values of the input signals in dependence on a time-averaged intensity (for example, amplitudes or energies or loudness) of the respective spectral bin in the different input signals. Consequently, a meaningful weighting can be achieved, and at the reliability of the phase values can be improved.

An embodiment according to the invention creates an audio encoder for providing an encoded audio representation on the basis of a plurality of input audio signals. The audio encoder comprises a downmixer as described above. The downmixer is configured to provide a downmix signal on the basis of (advantageously complex-valued) spectral domain representations of the plurality of input audio signals. The audio encoder is also configured to encode the downmix signal, in order to obtain the encoded audio representation. It has been found that usage of such a downmixer in an audio encoder is particularly advantageous, because the reliability both of amplitude values and of phase values can be increased by the downmixer. Accordingly, the downmix signal is well-suited for a reconstruction of audio signals at the side of an audio decoder or also for a direct playback. In particular, since artifacts are comparatively small using the downmixing concept disclosed herein, the audio encoder can use a comparatively "clean" downmix signal, which facilitates the encoding and at the same time increases the quality of decoded audio signals.

Another embodiment according to the invention creates a method for providing a downmix signal on the basis of a plurality of (for example, complex-valued) input signals (which may, for example, be input audio signals). The method comprises determining (for example, computing or estimating) a magnitude value (for example, $M_R$ or $M_R^{Mod}$) of a spectral domain value of the downmix signal (for example, for a given spectral bin) on the basis of a loudness information of the input signals (for example, on the basis of loudness values associated with the given spectral bin of the input signals). The method comprises determining a (advantageously scalar) phase value (for example, $P_P$ or $P_P^{Mod}$) of the spectral domain value of the downmix signal (for example, for the given spectral bin), for example, independently from the determination of the magnitude value. The method also comprises applying the phase value (for example, $P_P$ or $P_P^{Mod}$) in order to obtain a complex number representation of the spectral domain value of the downmix signal (for example, for the given spectral bin) on the basis of the magnitude value of the spectral domain value. This method is based on the same consideration as the downmixer described above. It should also be noted that the method can be supplemented by any of the features, functionalities and details described herein, also with respect to the corresponding downmixer. The method can be supplemented by such features, functionalities and details individually or when taken in combination.

Another embodiment according to the invention creates a computer program for performing the method when the computer program runs on a computer.

BRIEF DESCRIPTION OF THE DRAWINGS

Embodiments according to the invention will subsequently described taking reference to the enclosed figures in which.

DETAILED DESCRIPTION OF THE INVENTION

1. Downmixer According to FIG. 1

Figure 1:
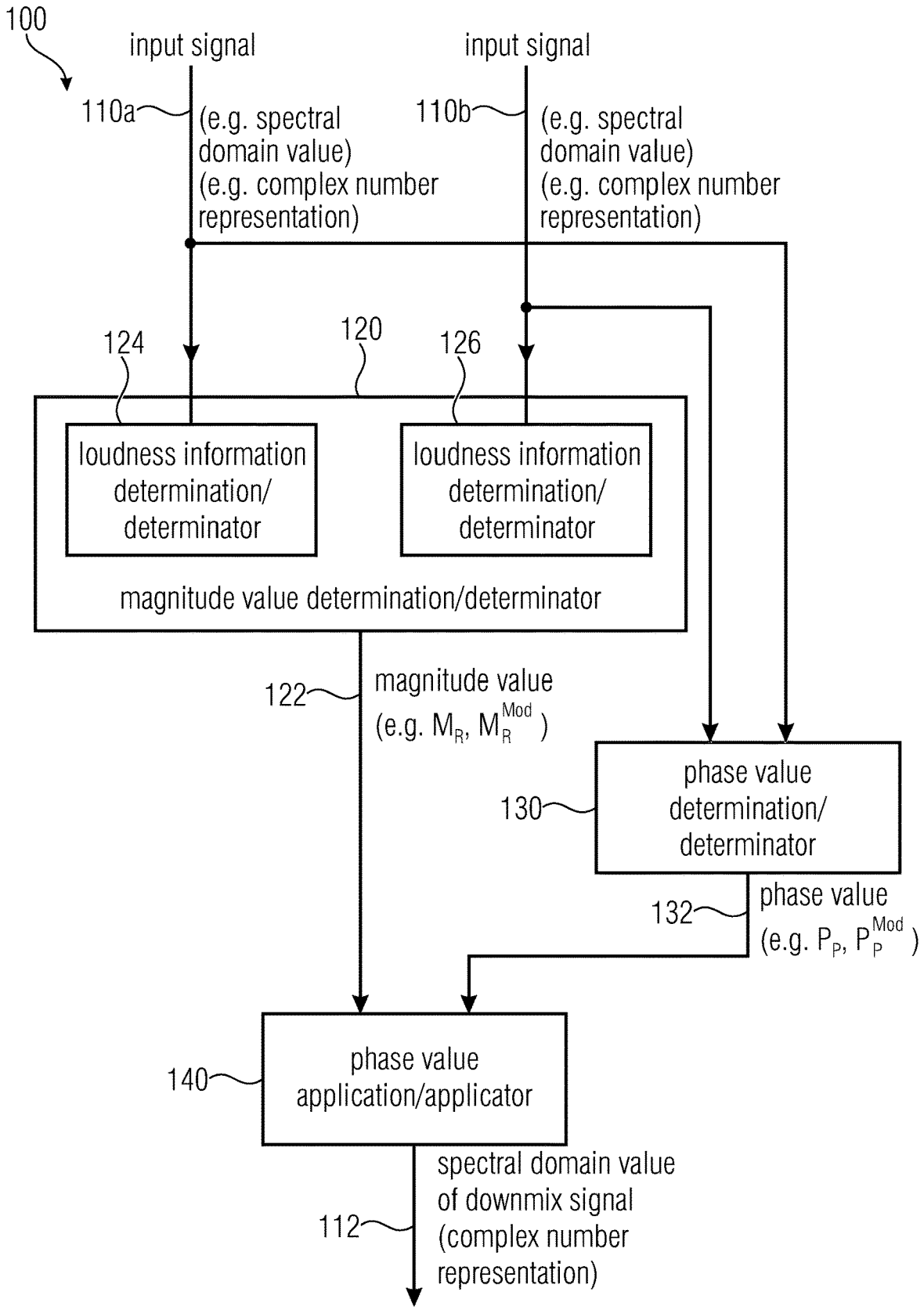
FIG. 1 shows a block schematic diagram of a downmixer, according to an embodiment of the invention.

FIG. 1 shows a block schematic diagram of a downmixer 100, according to an embodiment of the invention.

The downmixer is configured to receive a plurality of input signals 110*a*, 110*b* and to provide, on the basis thereof, a downmix signal 112. For example, the first input signal, which may be an input audio signal, may be represented by a sequence of spectral domain values (which are associated with different frequencies or spectral bins), which may, for example, be in a complex number representation. Moreover, the second input signal may also, for example, comprise a sequence of spectral domain values (which are associated with different frequencies or spectral bins) which may be represented in a complex number representation.

The downmix signal 112 may be represented by a spectral domain value of the downmix signal (or, generally, by a plurality of spectral domain values associated with different frequencies), which may be represented in the form of a complex number representation.

In the following, a processing of only one spectral bin will be considered. However, spectral domain values of different spectral bins may, for example, be handled independently and in the same manner.

The downmixer 100 comprises a magnitude value determination (which may also be considered as a magnitude value determinator) 120. The magnitude value determination 120 is configured to determine a magnitude value 122 of a spectral domain value 112 of the downmix signal (for example, for a given spectral bin) on the basis of a loudness information of the input signals 110*a*, 110*b* (for example, on the basis of loudness values associated with the given spectral bin of the input signals). For example, the magnitude value determination comprises a first loudness information determination (or determinator) 124, which determines a loudness of a spectral domain value of the first input signal 110*a*. Moreover, the magnitude value determination 120 also comprises a second loudness information determination (or determinator) 126, which determines a loudness information of a spectral domain value of the second input signal 110*b*. Moreover, the magnitude value determination 120 typically determines the magnitude value 122, such that the magnitude value 122 (which may be the basis for a determination of a magnitude value of a spectral domain value of the downmix signal, or which may even be used as the magnitude value of the spectral domain value of the downmix signal) is based on a sum loudness of the respective spectral domain value of the first input signal 110*a* and of the respective spectral domain value of the second input signal 110*b*. However, the magnitude value 120 may comprise additional corrections, such that the magnitude value is corrected, in a well-defined manner, to correspond to a loudness which is smaller than the sum loudness or larger than the sum loudness, depending on the circumstances. However, it should be noted that the magnitude value is typically one scalar value which is associated with a certain spectral domain value (for example, associated with a certain spectral bin).

The downmixer 100 also comprises a phase value determination (or determinator) 130. Accordingly, the downmixer is configured to determine a (scalar) phase value 132 of a spectral domain value 112 of the downmix signal (for example, for the given spectral bin). For example, the phase value determination 130 receives the first input signal 110*a* and the second input signal 110*b*, or a spectral domain value (associated with a certain spectral bin) of the first input signal 110*a* and a spectral domain value (associated with the certain spectral bin) of the second input signal 110*b*. For example, the phase value determination (or determinator) 130 determines the phase value 132 independently from the determination of the magnitude value 122.

Moreover, the downmixer also comprise a phase value application (which can also be considered as a phase value applicator) 140. Accordingly, the downmixer is configured to apply the phase value 132, in order to obtain a complex-valued number representation of the spectral domain value 112 of the downmix signal (for example, for the given spectral bin) on the basis of the magnitude value 122 of the spectral domain value of the downmix signal.

Generally speaking, it should be noted that the downmixer 100 may, for example, determine the magnitude value 112 and the phase value 132 independently, and then, as a final processing step, apply the phase value 132 to obtain a complex number representation of the spectral domain value of the downmix signal. For example, the phase value 132 can be used to derive an inphase component and a quadrature component of the spectral domain value of the downmix signal on the basis of the magnitude value, such that a Cartesian representation (real-part and imaginary-part representation) of the complex-valued spectral domain value of the downmix signal is obtained. By deriving the magnitude value on the basis of the loudness information of the input signals (for example, on the basis of loudness values of the given spectral bin of the input signals) a good degree of numerical stability can be obtained while excessive loudness (which would, for example, be caused by a simple addition of spectral domain values in the case of constructive interference) and significant loudness drops (which would be caused by destructive interference in case a simple complex-valued addition of spectral domain values was performed) can be avoided. Also, numerical instabilities which arise from solutions performing a strong post-correction of complex-added values can be avoided.

To conclude, a downmixer as described with reference to FIG. 1 comprises significant advantages, which partially arise from the separate processing of magnitude values 122 and phase values 132, and which also arise from the consideration of the loudness information in the determination of the magnitude value 122.

Moreover, it should be noted that the downmixer 100 according to FIG. 1 can be supplemented by any of the features, functionalities and details described herein, both individually and taken in combination. Also, features, functionalities and details described with respect to the downmixer 100 can be introduced into the other embodiments, both individually and taken in combination.

2. Downmixer According to FIG. 2.

Figure 2:
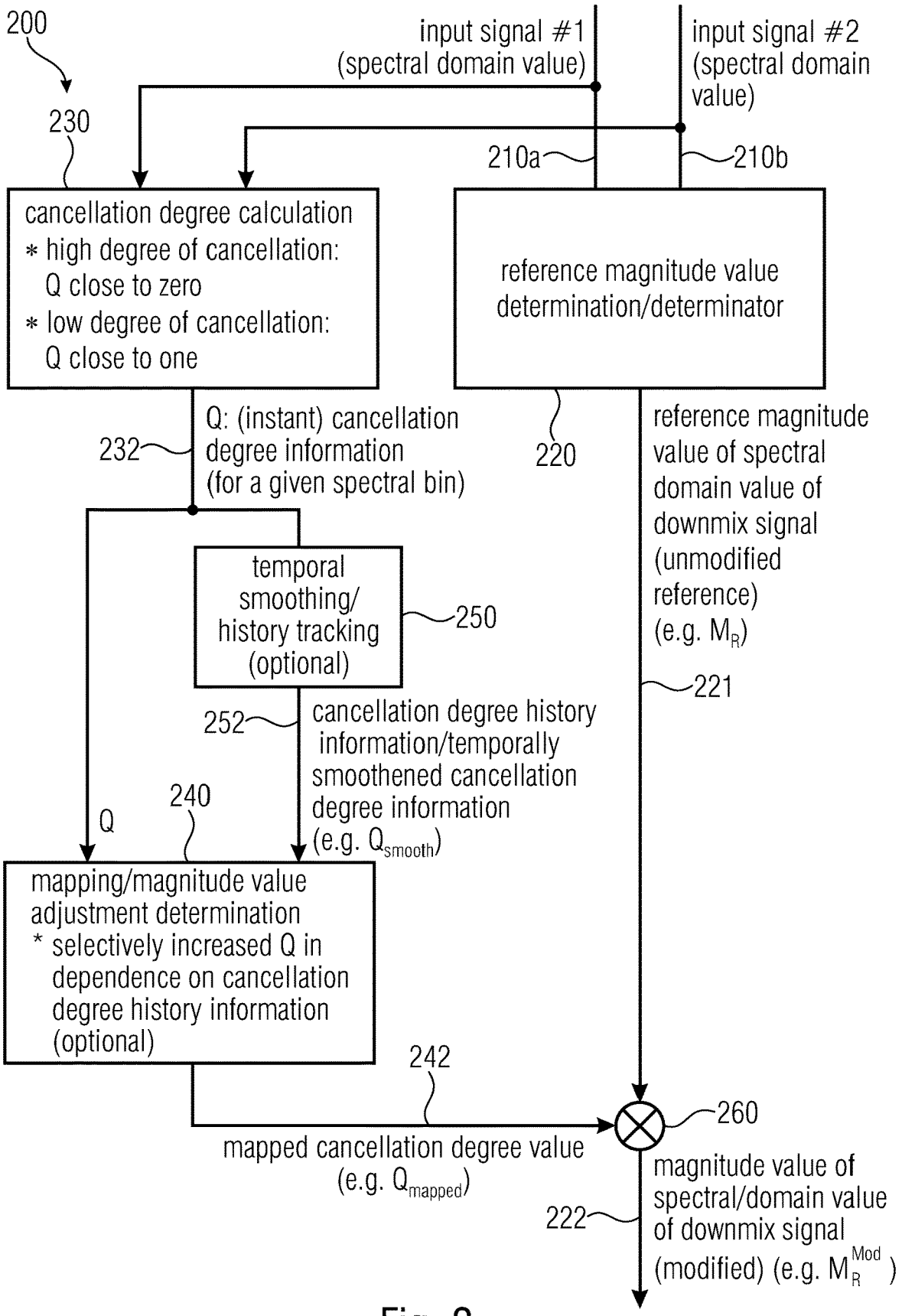
FIG. 2 shows an excerpt of a block schematic diagram of a downmixer, according to another embodiment of the present invention.

FIG. 2 shows an excerpt of a block schematic diagram of a downmixer, according to an embodiment of the invention.

In particular, FIG. 2 represents a derivation of a magnitude value 222 (which may correspond to the magnitude value 122 described taking reference to FIG. 1) on the basis of a first input signal 210*a* (which may correspond to the first input signal 110*a* described taking reference to FIG. 1) and also on the basis of a second input signal 210*b* (which may correspond to the second input signal 110*b* described taking reference to FIG. 1).

It should also be noted that a processing unit or functional block 200 shown in FIG. 2 may, for example, take the place of the magnitude value determination (magnitude value determinator) 120 shown in FIG. 1.

The functional block 200 comprises a reference magnitude value determination or reference magnitude value determinator 220, a functionality of which may, in general, be similar to the functionality of the magnitude value determination/magnitude value determinator 120. For example, the reference magnitude value determinator 220 may be configured to provide a reference magnitude value 221 on the basis of the first input signal 210*a* and on the basis of the second input signal 210*b*. For example, the reference magnitude value determination 220 may derive the reference magnitude value 221 of a spectral domain value of the downmix signal (which may be considered as an unmodified reference) on the basis of a loudness information of the input signals 210*a*, 210*b*. For example, the reference magnitude value 221 may be a scalar value which is associated with a given spectral bin of the downmix signal and may be based on a loudness value associated with the given spectral bin of the first input signal 210*a* and a loudness value associated with the given spectral bin of the second input signal 210*b*. Accordingly, the reference magnitude value of the spectral domain value may, for example, correspond to a loudness which is larger than the smallest loudness value (for example, of the given spectral bin of the input signals) and which is typically even larger than the largest loudness value of the given spectral bin of the input signals 210*a*, 210*b*. In other words, the reference magnitude 221 is typically not particularly small unless a given spectral bin comprises a very small signal strength in both input signals 210*a*, 210*b*. On the other hand, the reference magnitude value 221 typically does also not comprise an excessively large value, since it is based on loudness information of all the input signals. Advantageously, the reference magnitude value 221 is unaffected by constructive and destructive interference of the input signals, which would occur if the phase of the input signals was considered in the determination of the reference magnitude value. Rather, the reference magnitude value may, for example, reflect an addition of loudness in the given spectral bin under consideration of the input signals.

Accordingly, the reference magnitude value 221 is a good basis for possible corrections, since it can be assumed that it lies within a numerically reasonable range and can therefore both be downscaled and up-scaled without causing numerical instabilities.

Functional block 200 also comprises a cancellation degree calculation 230, which is configured to receive the input signals 210*a*, 210*b* (or at least a spectral domain value of a given spectral bin under consideration). The cancellation degree calculation 230 provides a cancellation degree information 232, which generally describes how much cancellation (destructive interference) there would be if the spectral domain values of the given spectral bin under consideration of the input signals were added as complex numbers (i.e., under consideration of their phases and possible cancellation effects). Different mechanisms for computing the cancellation degree information 232 (which can be considered as a current or instant cancellation degree information, and which may be associated to the given spectral bin under consideration) can be used. However, in an advantageous approach, the cancellation degree information 232, which is also designated with Q, takes a value close to zero if there is a high degree of cancellation, and the cancellation degree information Q takes a value close to 1 if there is a low degree of cancellation (for example, in the given spectral bin under consideration).

The cancellation degree information 232 may, for example, be used to scale the reference magnitude value 221, in order to derive the (scaled) magnitude value 222 of the spectral domain value. However, even though it would be possible to directly use the cancellation degree information 232 to scale the reference magnitude value 221, it is of advantage to have an additional processing, which will be described in the following.

In an embodiment, the functional block 200 also comprises a mapping (or mapper) 240, which receives the (instant/current) cancellation degree information (which describes the degree of cancellation in a given spectral bin under consideration associated with a time block to be currently processed) and provides a mapped cancellation degree value (or mapped cancellation degree information) 242 on the basis thereof. For example, the mapped cancellation degree value is provided to a scaling (or scaler 260), which scales the reference magnitude value 221 on the basis of the mapped cancellation degree value 242, to thereby derive the magnitude value 222 of the spectral domain value of the downmix signal.

The functional block 200 advantageously comprises a temporal smoothing/history tracking 250, which provides a cancellation degree history information or a temporally smoothened cancellation degree information 252 to the mapping/magnitude value adjustment determination 240. In other words, the mapping/magnitude value adjustment determination 240 advantageously receives the instant (current) cancellation degree information 232 and the cancellation degree history information 252 (which may, for example, be a temporally smoothened cancellation degree information). Accordingly, the mapping/magnitude value adjustment determination 240 may provide the mapped cancellation degree value 242 on the basis of the instant (current) cancellation degree information 232, wherein the instant (current) cancellation degree information 232 may be selectively increased in dependence on the cancellation degree history information 252 to thereby derive the mapped cancellation degree information 242.

For example, the cancellation degree information 232 may be a value within a range between 0 and 1, such that a direct scaling of the reference magnitude value 221 with the cancellation degree information 232 would typically result in a reduction of the energy. However, it has been found that the reference magnitude value 221 should be scaled down by the scaler 260 in case that there is a high degree of cancellation between the input signals 210*a*, 210*b* (for example, within a spectral bin under consideration). On the other hand, it has also been found that it is unproblematic to "scale up" the reference magnitude value 221 in a moderate manner at times at which there is a low degree of cancellation. In other words, it has been found that the mapped cancellation degree value 242 should be significantly smaller than 1 (for example, smaller than 0.5, or even smaller than 0.3, or even smaller than 0.1) if there is a high degree of cancellation at a current instant of time. On the other hand, it has been found that that it is unproblematic if the mapped cancellation degree value 242 is somewhat larger than 1 (for example, between 1 and 1.2, or between 1 and 1.5, or even between 1 and 2) at times at which there is a low degree of cancellation. Accordingly, the mapping/magnitude value adjustment determination 240 selectively increases the mapped cancellation degree value 242 with respect to the instant (current) cancellation degree information 232 in dependence on the cancellation degree history information 252. For example, if the instant cancellation degree information 232 has taken a comparatively small value over a certain period of time, the mapping/magnitude value adjustment determination 240 may increase the mapped cancellation degree value 242 with respect to the instant cancellation degree information 232 (at least in the presence of a low degree of cancellation) to be larger than 1 (at least at a time instance at which there is a low degree of cancellation) to thereby at least partially compensate a loss of energy which was caused by the comparatively small cancellation degree information 232 (which normally also results in a comparatively small mapped cancellation degree value 242 which is significantly smaller than 1). On the other hand, if the instant (current) cancellation degree information 232 has been close to 1, the increase of the mapped cancellation degree value 242 with respect to the instant (current) cancellation degree information 232 is typically small, because it is not necessary in such a situation to compensate a large loss of energy. To conclude, the extent (or amount) to which the mapped cancellation degree value 242 is increased over the instant (current) cancellation degree information is dependent on the cancellation degree history information 252, and the increase is comparatively large if there has been a (comparatively) large loss of energy in the past, and the increase is comparatively small if there has been only a (comparatively) small loss of energy in the past.

Typically, a comparatively small cancellation degree information (close to 0, indicating a high degree of cancellation) also results in a comparatively small mapped cancellation degree value 242 (which is substantially smaller than 1). On the other hand, if the instant cancellation degree information is close to 1 (indicating a low degree of cancellation), then the mapped cancellation degree value 242 can be smaller than 1 or can also be larger than 1, for example if the instant cancellation degree information took a value substantially smaller than 1 over a certain period of time before. Accordingly, the magnitude value 222 of the spectral domain value, which is obtained by the scaler 260 is typically smaller than the reference magnitude value 221 if there is a high degree of cancellation, and is typically even larger than the reference magnitude value 221 if there is a low degree of cancellation and if there has been a high degree of cancellation over a certain period of time before.

As mentioned above, the functional block 200 may, for example, replace the magnitude value determination/determinator 120 of FIG. 1 in some embodiments of the invention.

Moreover, it should be noted that the functional block 200 may be supplemented by any of the features, functionalities and details described herein, also with respect to the other embodiments. Such features, functionalities and details can be added to the functional block 200 individually or taken in combination. In particular, the equations described for the computation of the instant (current) cancellation degree information Q, for the calculation of the cancellation degree history information $Q_{smooth}$, for the computation of the mapped cancellation degree information $Q_{mapped}$, for the computation of the reference magnitude value $M_R$ and for the calculation of the (scaled) magnitude value ($M_R^{Mod}$) described herein can optionally be used when implementing the functionality of the functional block 200. However, it should be noted that it is sufficient if one or more of said equations are used, and that it is not necessary to use all of these equations in combination.

3. Phase Value Determination According to FIG. 3

Figure 3:
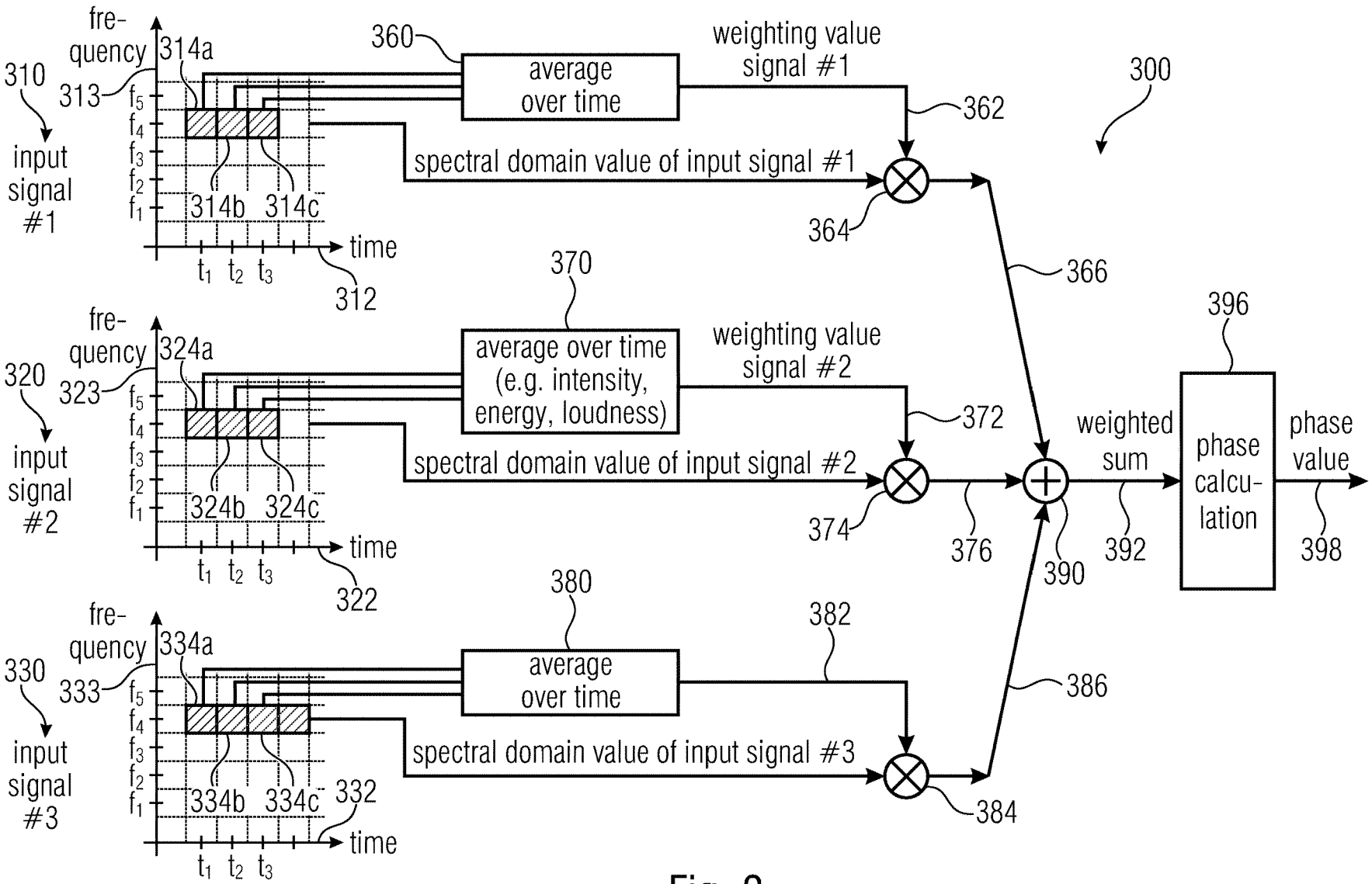
FIG. 3 shows a block schematic diagram of a phase value determination, according to an embodiment of the invention.

FIG. 3 shows a schematic representation of a phase value determination, according to an embodiment of the present invention. The phase value determination according to FIG. 3 is designated in its entirety with 300. It should be noted that the phase value determination 300 may, optionally, replace the phase value determination 130 in the downmixer 100 according to FIG. 1. It should be noted that the phase value determination 300 can optionally be used in combination with the functional block 200 (which may replace the block 120 in the downmixer 100 according to FIG. 1). However, the phase value determination 300 can also be used in combination with the magnitude value determination 120.

At reference numeral 310, a time-frequency domain representation of an input signal (for example, of an input audio signal) is shown. An abscissa 312 describes a time and an ordinate 313 describes a frequency. Accordingly, time-frequency bins are shown. For example, three time-frequency bins 314*a*, 314*b*, 314*c* are highlighted, which are all associated with frequency (or frequency range, or frequency bin) $f_4$, and which are associated with times (or time portions, or frames) $t_1$, $t_2$, $t_3$.

Similarly, at reference numeral 320, a graphic representation of a time-frequency domain representation of a second input signal is shown. An abscissa 322 describes a time and an ordinate 323 describes a frequency. Spectral bins 324*a*, 324*b*, 324*c* (for example, at frequency $f_4$ and at times $t_1$, $t_2$, $t_3$) are highlighted, wherein, for example, a complex-valued spectral domain value is associated with each of the spectral bins 324*a*, 324*b*, 324*c*.

Similarly, a schematic representation at reference numeral 330 shows a time frequency domain representation of a third input signal. An abscissa 332 describes a time and ordinate 333 describes the frequency. Three spectral bins 334*a*, 334*b*, 334*c* at frequency $f_4$ and at times $t_1$, $t_2$, $t_3$ are highlighted.

In the following, a processing, which may be performed by the phase value determination (for example, by the phase value determination/phase value determinator 130) will be described. For example, a first averaging (or a first averager) 360 may form an average (for example, of an intensity, or of an energy or of a loudness) over spectral domain values of a plurality of spectral bins which are associated with the same frequency and which are associated with subsequent times. The averaging may be a sliding-window averaging, or may be a recursive (finite-impulse-response) averaging. Moreover, it should be noted that the averaging may, for example, average the complex values of the spectral domain values, or may average magnitudes or loudness values of the spectral domain values. Accordingly, the averager 330 provides a weighting value 362.

Similarly, a second averaging (or a second averager 370 determines an average over time (for example, of an intensity, an energy or a loudness) of the spectral domain values associated with the spectral bins 324*a* to 324*c* of the second input signal, to thereby obtain a weighting value 372 for the second input signal.

Moreover, a third averaging (or third averager 380) determines an average over time (for example, of the intensity, of the energy, or of the loudness) over the spectral domain values associated with the spectral bins 334*a* to 334*c* of the third input signal, to thereby obtain a weighting value 382 for the third input signal.

In other words, the first averaging 360, the second averaging 370 and the third averaging 380 may perform similar or identical functionalities but operate on spectral domain values of different of the input signals.

The phase value determination 300 also comprises a scaling or weighting 364 of a current spectral domain value of the first input signal (or derived from the first input signal), to thereby obtain a scaled spectral domain value 366 of the first input signal. Similarly, the phase value determination comprises a second scaling or weighting 374, wherein a current spectral domain value of the second input signal (for example, associated with a currently processed spectral bin) is scaled using the weighting value 372 derived from the second input signal. Accordingly, a weighted spectral domain value 376 of the second input signal is obtained. Similarly, the phase value determination 300 comprises a third scaling or weighting 384, which scales the current spectral domain value of the third input signal using the weighting value 382 of the third input signal, to thereby obtain a spectral domain value 386 of the third input signal.

The phase value determination 300 also comprises combining 390 the scaled spectral domain value 366 of the first input signal, the scaled spectral domain value 376 of the second input signal and the scaled spectral domain value 386 of the third input signal. For example, a sum-combination is performed, wherein it should be noted that scaled complex values (for example, in a Cartesian representation comprising real-component and imaginary component) are combined. Accordingly, as a result of the combining 390, a weighted sum 392 is obtained which is typically a complex value, and which is typically in a Cartesian representation (with a real-component and an imaginary component). The phase value determination 300 also comprise a phase calculation 396, in which a phase value of the weighted sum 392 is computed and provided as a phase value 398. The phase value 398 may, for example, correspond to the phase value 132 described with reference to FIG. 1 and may be used by the phase value application 140.

The phase value determination 300 is based on the idea that a current spectral domain value of an input signal, which was comparatively strong (for example, when compared to other input signals) in the past (for example, in spectral bins associated with earlier times but with the same frequency as the current spectral domain value) should be weighted stronger in the phase calculation 396 when compared to spectral domain values of one or more input signals which were comparatively weaker in the past (for example, in spectral bins having the same frequency as the current spectral domain value but associated with earlier times). It has been found that a likelihood, that the phase value 398 comprises a big error, or comprises a fast change, is reduced by such a concept, and that, as a result, (audible) artifacts in the downmix signal can be reduced or avoided by using such a phase value determination. In other words, the phase calculation 396, which is performed to obtain the phase value 398, is not performed on the basis of an equally-weighted combination of current spectral domain values of different input signals, but the current spectral domain values of different input signals are weighted in accordance with the past time average of intensity, energy or loudness (for example, in past spectral bins of the same frequency). Thus, the reliability of the phase calculation is improved.

However, it should be noted that any of the features, functionalities and details described herein, for example, with respect to a phase value determination, can also be applied in combination with the phase value determination 300, both individually, and in combination. Moreover, it should be noted that the phase value determination 300 can optionally be introduced into any of the other embodiments described herein.

4. Embodiment According to FIG. 5

In the following, an embodiment of a downmixer will be described taking reference to FIG. 5.

Figure 5:
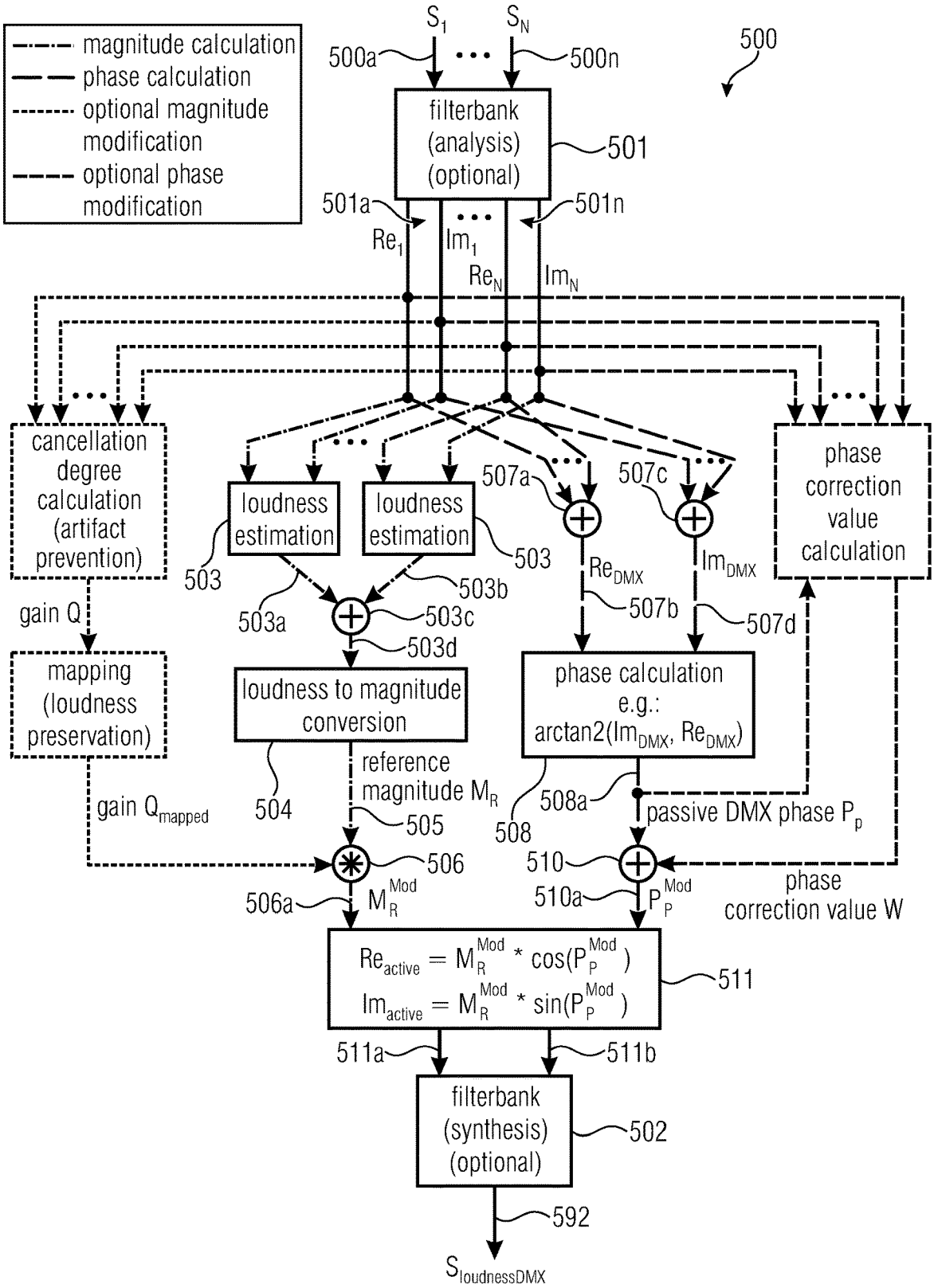
FIG. 5 shows a signal flowchart for a loudness-preserving downmix, according to an embodiment of the invention.

FIG. 5 shows a block schematic diagram of a downmixer 500, according to an embodiment of the invention. The downmixer is configured to receive a plurality of input signals 500*a* to 500*n*, which are also designated with $s_1$ to $s_N$.

Moreover, the downmixer 500 provides, as an output signal, a downmix signal 592, which is also designated with $s_{LoudnessDMX}$. The downmixer 500 optionally comprises a filter bank 501, which is, for example, an analysis filter bank (or, generally speaking, which serves to perform an analysis). For example, the filter bank 501 may separately analyze the different input signals 500*a* to 500*n*. For example, the filter bank may provide a complex-valued representation for each of the input signals 500*a* to 500*n*. For example, the filter bank 501 provides a first complex-valued representation 501*a* on the basis of the first input signal 500*a*, and provides an n-th complex valued representation 501*n* on the basis of the n-input signal 500*n*. For example, the first complex-valued representation 501*a* may comprise a plurality of spectral values, for example, one for each spectral bin. The individual spectral values may be complex-valued, and may, for example, be represented in a Cartesian form (with a separate number representation of a real part and of an imaginary part).

In the following, the processing will be described for one spectral bin only. However, it should be noted that different spectral bins (having associated therewith different frequencies) may, for example, be processed separately but, for example, using the same concept.

For example, the spectral domain representation of the spectral bin under consideration of the first input signal is designated with $Re_1$ (number representation of the real part of the spectral domain value of the first input signal) and $lm_1$ (number representation of the imaginary part of the spectral domain value of the first input signal). Similarly, the spectral domain representation of the n-th input signal is designated with $Re_N$ (number representation of the real part of the spectral domain value of the n-th input signal) and $lm_N$ (number representation of the imaginary part of the spectral value of the n-th input signal).

The downmixer also comprises a loudness estimation 503, wherein loudness is separately estimated for different input signals. For example, a loudness value 503*a* of the first input signal 500*a* is computed or estimated on the basis of the number representation of the real part of the spectral domain value of the first input signal and on the basis of the number representation of the imaginary part of the spectral domain value of the first input signal (for the spectral bin under consideration). Similarly, a loudness of the n-th input signal is computed or estimated on the basis of the number representation $Re_N$, $lm_N$ of the spectral domain value of the n-th input signal (for the spectral bin under consideration) to thereby obtain a loudness value 503*b*. The separate loudness estimation blocks or units are designated with 503.

Moreover, the individual loudness values 503*a*, 503*b*, which individually represent loudness of the individual input signals 500*a* to 500*n*, are combined (for example, summed) in a combiner 503*c*, to thereby obtain a sum loudness value 503*d*. Accordingly, the sum loudness value 503*d* describes a sum loudness of the input signals 501*a* to 501*n*. The downmixer 500 also comprises a loudness-to-magnitude conversion 504, which receives the sum loudness value 503*d* and converts the sum loudness value 503*d* into a magnitude value 505, which may be considered as a reference magnitude $M_R$. The reference magnitude value 505 may be a scalar value, which represents the sum loudness described by the sum loudness value 503*d* (but which may be in the domain of an amplitude value).

The downmixer 500 may, optionally, comprise a scaler 506, which may, however, be inactive in the embodiment of FIG. 5. Accordingly, a modified ("scaled") magnitude value 506*a* may be identical to the reference magnitude value 505.

The downmixer 500 also comprises a phase calculation 508. The phase calculation 508 may receive a number representation of a complex-valued sum value which combines the spectral domain values 501*a* to 501*n*. For example, the number representations $Re_1$ to $Re_N$ of the real parts of the spectral domain values 501*a* to 501*n* may be summed up (for example, in a summer or a combiner 507*a*), to obtain a number representation 507*b* (also designated with $Re_{DMX}$) of a real part of the sum value. Similarly, number representations $lm_1$ to $lm_N$ of the imaginary parts of the spectral domain values 501*a* to 501*n* are summed up (for example, by a summer or a combiner 507*c*), to obtain a number representation 507*d* (also designated with $Lm_{DMX}$) of an imaginary part of the sum value.

The phase calculation 508 computes a phase value 508*a* on the basis of the number representation 507*b* of the real part of the sum value and on the basis of the number representation 507*d* of the imaginary part of the sum value. For example, the phase calculation may comprise an arcus tangents operation, wherein a distinction between the quadrants in which the number representations of the real part and of the imaginary part of the sum value are located may be considered. Thus, the phase value 508*a* may, for example, indicate a range between 0 and 360°, or between 0 and 2π, or between −180° and +180°, or between −π and +π.

The downmixer 500 also comprises an optional phase correction 510, which is typically inactive in the embodiment according to FIG. 5.

The downmixer 500 also comprises a phase value application/number representation reconstruction 511. The phase value application receives the magnitude value 506*a* (which may be identical to the reference magnitude value 505 in the present embodiment) and also receives the corrected phase value 510*a*, which may be identical to the phase value 508*a* in the present embodiment.

The phase value application 511 determines a number representation of a real part (Reactive) of a spectral domain value of the downmix signal and also determines a number representation of an imaginary part of the spectral domain value of the downmix signal. Accordingly, the phase value application 511 provides a number representation 511*a* of the real part of the spectral domain value of the downmix signal and a number representation 511*b* of an imaginary part of the spectral domain value of the downmix signal.

Both the number representation of the real part and the number representation of the imaginary part 511*a*, 511*b* are provided to an optional filterbank 502, which may be a synthesis filterbank. The filterbank 502 may be configured to provide a time domain representation 592 of the downmix signal on the basis of number representations of (complex valued) spectral domain values of the downmix signal, for example for a plurality of spectral bins (for example, having associated different frequencies).

Accordingly, a downmix signal can be obtained, wherein the magnitude value and the phase value are processed independently (for example, as scalar values) and wherein a complex-valued number representation of spectral domain values is only generated as a final processing step (for example, before a re-synthesis of a time domain representation).

In the following, the concept as described taking reference to FIG. 5 will be summarized. It should be noted that the concepts described in the following can be used independently from the above mentioned details. However, any of the details described in the following can also be used in combination with any of the embodiments described herein.

It should be noted that the concept can be considered as a "loudness preserving downmix". The new approach described herein does not simply downmix the input signals and then tries to correct the unwanted side effects afterwards. It calculates the desired (loudness preserving) magnitude and the phase information independently from each other, based on two different concepts.

For example, the desired (reference-) magnitude is calculated directly. It is free of any undesired interferences and therefore free of any undesired downmix (DMX) artifacts when combined with appropriate phase information. The phase information is calculated separately and originates from a passive downmix (DMX).

In FIG. 5, an embodiment of the invention is shown exemplary for one frequency band (between the filterbank analysis 501 and synthesis 502). Of course, different buffer sizes are possible. Moreover, it should be noted that the cancellation degree calculation (artifact prevention) and the mapping (loudness preservation), which are shown in FIG. 5, are not essential components of the embodiment according to FIG. 5 but should be considered as optional extensions. Similarly, the phase correction value calculation should be considered as an optional supplement.

In the following, some additional explanations will be given regarding the calculation of the magnitude or reference magnitude (505 or 506*a*) and regarding the calculation of the phase.

(Reference-)Magnitude:

The input signals are mixed down in a loudness-preserving manner to form the magnitude $M_R$ 505, which is shown by red/continuous lines, or by lines labelled "magnitude calculation" in FIG. 5, as follows:

1. The loudness of each input signal is calculated (loudness estimation 503); the loudness can represent the loudness based on the human auditory system, the energy values, the magnitude values, etc.;
2. The loudness values are summed up;
3. The loudness summation is translated into a magnitude (loudness to magnitude conversion 504); for example, the square root is used for energy values;
4. Optional: the weighting of $M_R$ (reference magnitude $M_R$ 505) leads to the modified (or scaled) magnitude $M^{Mod}{}_R$ 506 a (for example, using the scaling 506); further details will be described below in a describing a loudness downmix with adaptive reference magnitude; this step can be performed in order to avoid potential artifacts that can appear caused by erroneous phase information.

Phase:

The phase $P_P$ 508*a* (also designated as passive DMX phase $P_P$) is derived from the passive downmix (for example, obtained by the combiners or adders 507*a*, 507*c* and designated with 507*b*, 507*d*), wherein the derivation of the phase is shown with blue/continuous lines or lines labelled "phase calculation" as follows:

1. The input signals are mixed down in a passive manner (simple addition), for example, in the combiners or adders 507*a*, 507*c*; it is optionally possible to use a differently motivated downmix DMX in the combiners or adders 507*a*, 507*c*; In this case, however, both the loudness summation and the additional procedures described below in the sections describing a "loudness downmix with adaptive reference magnitude" and a "loudness downmix with adaptive phase" should be processed (or need to be processed) in the sense of the different type of downmix;

2. $Re_{DMX}$ and $Im_{DMX}$ (507*b*, 507*d*) are used in order to calculate the phase information (for example, using the phase calculation 508), for instance by making use of a four-quadrant inverse tangent function.
3. Optional: the phase $P_P$ 508*a* (also designated as passive DMX phase $P_P$) can be modified to form a corrected or modified phase value $P^{Mod}{}_P$ 510*a* (for example, using a combiner or adder 510). Details regarding this issue are described below, for example, in the section describing a loudness downmix with adaptive phase; This step can be performed in order to create a phase response without phase jumps.

The reference magnitude $M_R$ (505) (or the modified magnitude value $M_{ModR}$ 506*a*) and the phase $P_P$ (508*a*) (or the modified phase $P^{Mod}{}_P$ 510*a*) are combined in the phase value application 511, i.e., going from polar to Cartesian form (or number representation).

5. Embodiment According to FIG. 6

Figure 6:
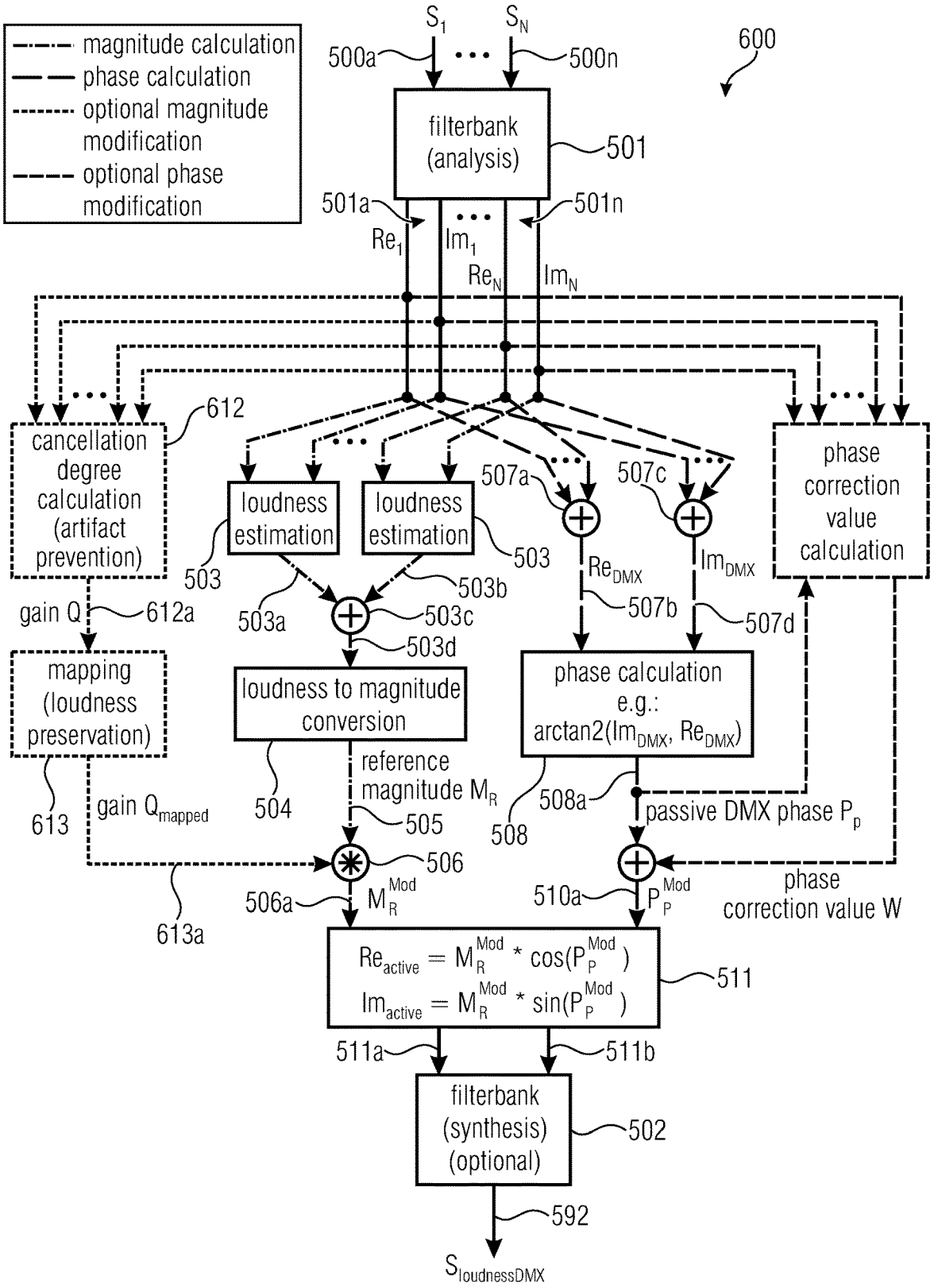
FIG. 6 shows a signal flowchart of a loudness downmix with adaptive reference magnitudes.

FIG. 6 shows a block schematic diagram of a downmixer using a loudness-downmix with adaptive reference magnitude. It should be noted that the downmixer 600 according to FIG. 6 is similar to the downmixer 500 according to FIG. 5 such that identical signals, blocks, features and functionalities will not be described again. Also, it should be noted that identical features and signals are designated with identical reference numerals such that reference is made to the description above.

However, in addition to the downmixer 500, the downmixer 600 comprises a cancellation degree calculation 612, which can be considered as an artifact prevention, and a mapping 613, which can be considered as a loudness preservation. For example, the cancellation degree prevention 612 receives the spectral domain values 501*a* to 501*n* (or, more precisely, the Cartesian number representations thereof). The cancellation degree calculation 612 provides a gain value 612*a* which is also designated with Q, to the mapping 613.

The mapping 613 receives the gain value 612 (Q) and provides, on the basis thereof, a mapped gain value 613*a*, which is also designated with $Q_{mapped}$, to the scaler 506, wherein the scaler 506 scales the reference magnitude value 505 using the mapped gain value 613*a* to thereby obtain the scaled magnitude value 506*a* which is input into the phase value application 511. For example, the cancellation degree calculation 612 may determine the gain value 612*a* such that the gain value 612*a* takes a comparatively small value (for example, a value to close to zero) if there is a high degree of cancellation and to determine the gain value 612*a* to take a comparatively larger value (for example, a value close to one) when there is a comparatively small degree of cancellation between the input signals (for example, when considering the combination of the input signals by a complex-valued addition). Thus, the gain 612*a* is chosen to be small if it is found (or expected) that there would be a high degree of cancellation, which corresponds to a high degree of unreliability of the phase value or to the risk of phase jumps. On the other hand, the gain value 612*a* is chosen to be comparatively large if there is a small degree of cancellation which implies that the phase value is comparatively reliable and that there are no inappropriate phase jumps.

The mapping 613 helps to at least partially compensate an energy loss (at least over a time average) which would be caused by reducing the (scaled) magnitude value 506*a* in the case that there is a comparatively high cancellation degree. For example, the mapping 613 may obtain the mapped gain 613*a* in such a manner that the mapped gain is sometimes larger than one (for example, when there is a comparatively small cancellation degree and when there has been energy loss caused by comparatively small gain values Q previously) and such that the mapped gain value 613 is significantly smaller than one in other periods of time (for example, when there is a comparatively large cancellation degree).

Details regarding the cancellation degree calculation 612 and regarding the mapping 613 will be described in the following. However, reference is also made to the above explanations, wherein the above mentioned functionalities can optionally be introduced into the downmixer 600.

In the following, some additional explanations will be provided. In particular, it should be noted that the downmixer 600 is extended when compared to the downmixer 500 to better handle the case where there is a high cancellation degree.

Figure 8:
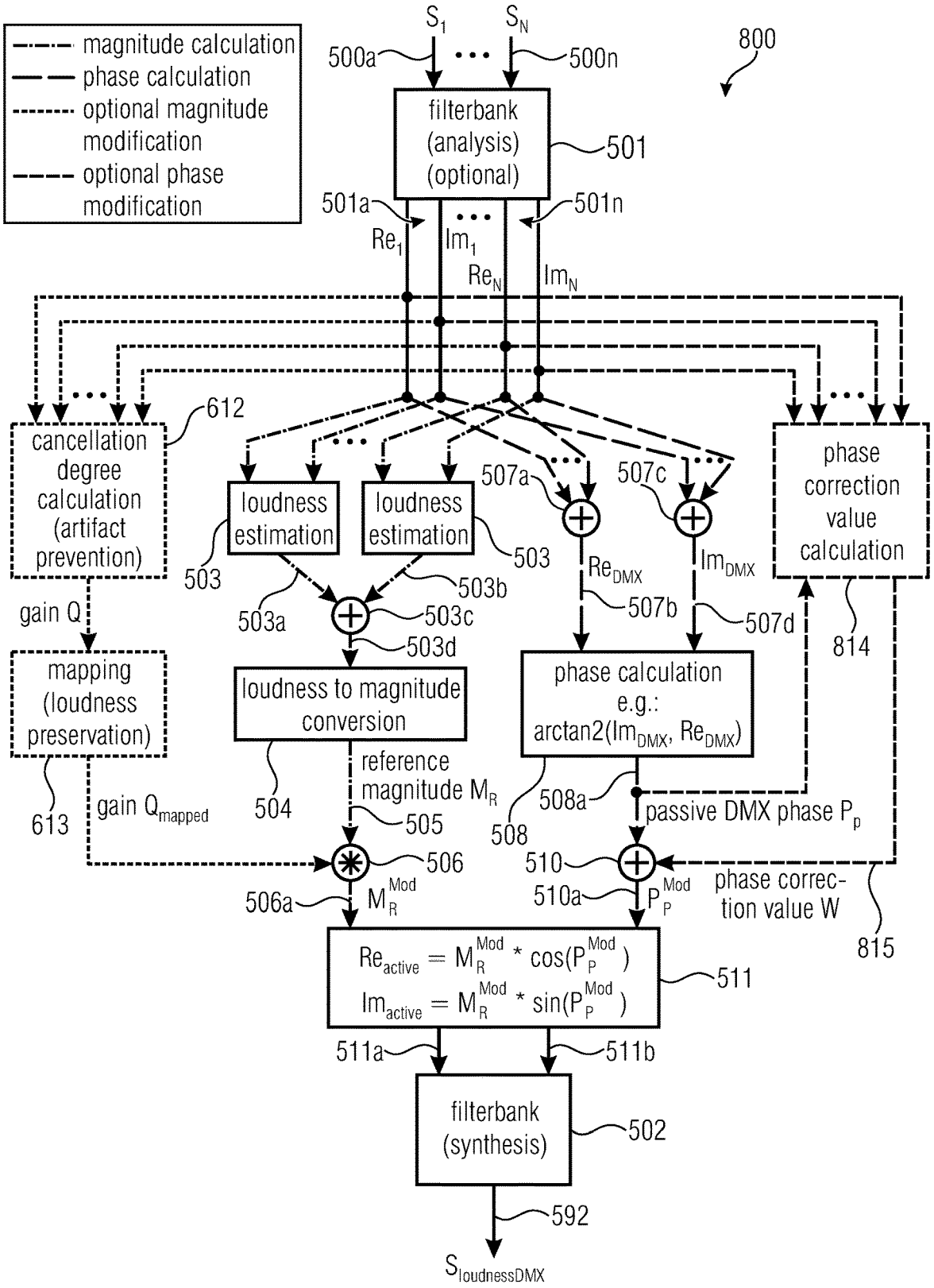
FIG. 8 shows a signal flowchart of a loudness downmix with adaptive phase.

However, generally, it can be said that the downmixer 600 according to FIG. 6 and also the downmixer 800 according to FIG. 8 provide optional solutions for special cases.

Figure 4:
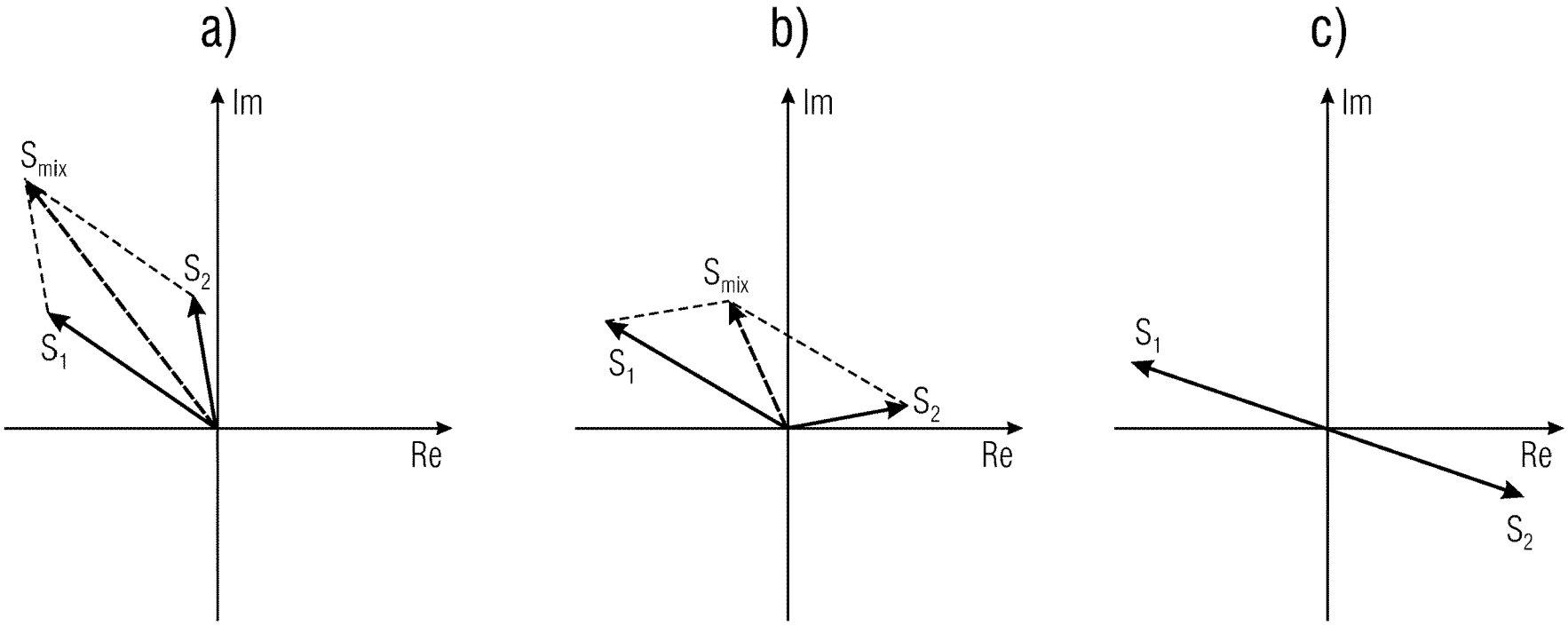
FIG. 4 shows a schematic representation of three types of interferences during a downmix procedure.

As already mentioned above (for example, the explanation of the case that both vectors do have similar magnitudes and an angular difference of approximately 180 degree; see FIG. 4*c*) the summation of the input signals can lead to very strong cancellations and produce strong phase jumps. In that case, the combination of the reference magnitude $M_R$ 505 with the erroneous phase information $P_P$ 508*a* would cause audible artifacts.

In order to overcome these artificially produced artifacts, two solutions are presented herein (for example, taking reference to FIGS. 6 and 8). The first solution comprises an attenuation of artifacts below an audible threshold value by lowering the reference magnitude. This is described in a section titled "loudness downmix with adaptive reference magnitude". As a second solution, which can be used alternatively or in addition to the first solution, a correction of the unreliable phase response can be made. This is described in a section titled "loudness downmix with adaptive phase".

Loudness Downmix with Adaptive Reference Magnitude

One possibility for overcoming the artificially produced artifacts is to attenuate the reference magnitude (for example, the reference magnitude 505) at certain points in time until it becomes in inaudible. For this, the "left wing" of the downmixer 500 according to FIG. 5 is activated (which is shown, for example, by red/dashed lines, or by lines type labeled "optional magnitude modification").

Regarding this issue, reference is made to FIG. 6, which shows a block schematic diagram of a downmixer with a loudness downmix with adaptive reference magnitude.

In the cancellation degree calculation 612, the input signals are branched off and the cancellation degree is calculated (or estimated). If there are no destructive interferences, then the gain value 612*a*, also designated with Q, is 1. In case of a full cancellation, the gain value 612 a, also designated with Q, is 0. This measure is used in order to detect potential erroneous phase information.

In a second step, which is designated as mapping 613, the cancellation degree is mapped to be a loudness-preserving gain $Q_{mapped}$ (for example, a mapped gain 613*a*). Both steps or functional blocks or functionalities 612, 613 are described in the following.

Figure 7:
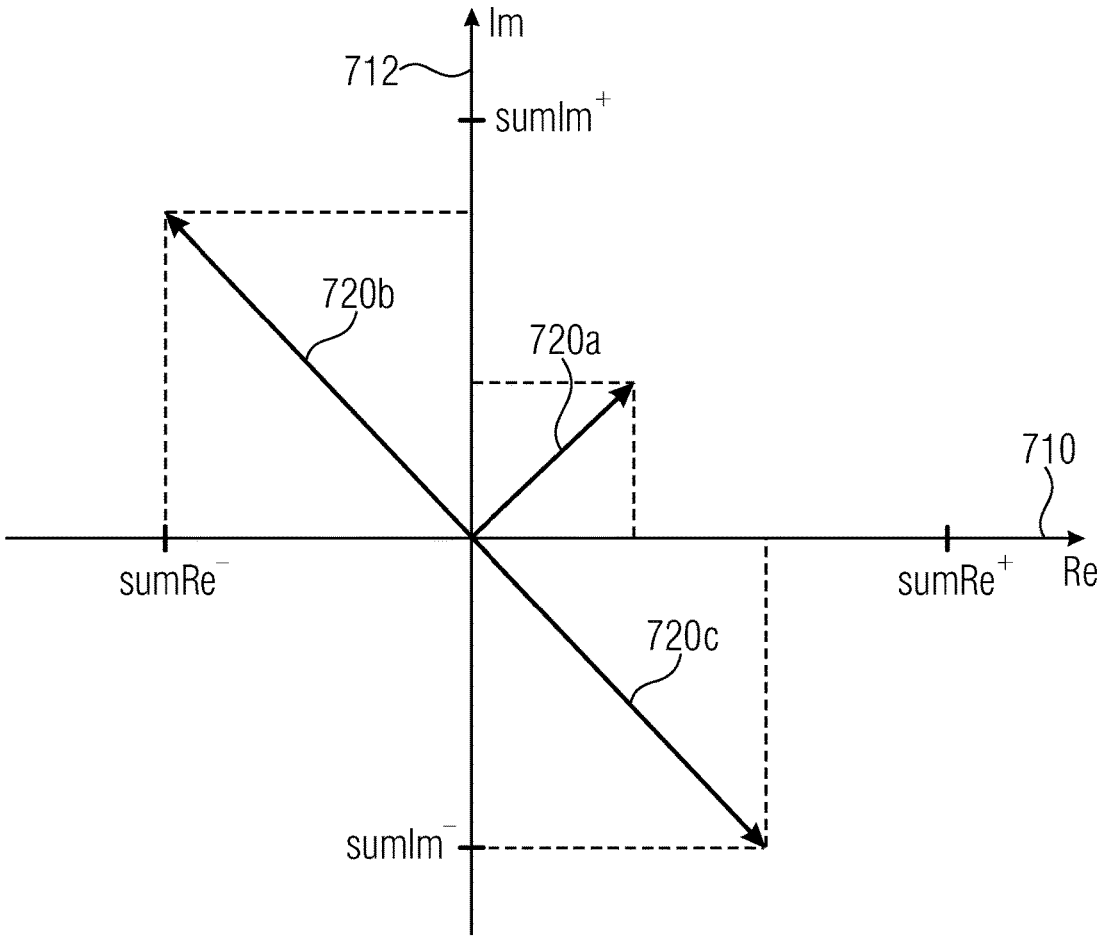
FIG. 7 shows a schematic representation of a derivation of the cancellation degree of the three input signals in the complex plane.

Artifact Prevention/Cancellation Degree Calculation 612:

FIG. 7 shows a schematic representation of a derivation of the cancellation degree of three input signals in a complex plane. An abscissa 710 designates a real part (or real component) and an ordinate 712 describes an imaginary part (or imaginary component). A first complex value representing, for example, a spectral bin of a first input signal, is represented by a first vector 720*a*, a second complex value, which may, for example, represent a spectral bin of a second input signal, is represented by a second vector 720*b*, and a third complex value, which may, for example, represent a spectral bin of a third input signal, is represented by a third vector 720*c*. In other words, in FIG. 7, one potential concept is exemplarily explained based on three input signals, represented by three vectors 720*a*, 720*b*, 720*c* in the complex plane.

The cancellation degree on the imaginary axis and real axis are calculated separately and combined in an energy-correct manner:

- The sum for the positive imaginary parts of the three vectors is calculated→$sumIm^+$
- The sum for the negative imaginary parts of the three vectors is calculated→$sumIm^-$
- The sum for the positive real parts of the three vectors is calculated→$sumRe^+$
- The sum for the negative real parts of the three vectors is calculated→$sumRe^-$
- The four sums are combined in the following equation However, it should be noted that, for the calculation of the cancellation degree, also an inclined axis system can be used (for example, with an orientation towards the phase angle of the passive downmix DMX). Moreover, it should be noted that the additional procedure described above can, optionally, calculate the degree of cancellation using an alternative formula. However, in some embodiments it is important to calculate the degree of strong cancellations accurately in order to reduce the reference magnitude sufficiently. It should be noted that the four sums (for example, the sum for the positive imaginary parts, the sum for the negative imaginary parts, the sum for the positive real parts and the sum for the negative real parts) may be combined in the following equation (or using the following equation), for example, to derive the gain value 612*a*:

$$sumIm^+ \geq |sumIm^-|,$$

$$sumRe^+ \geq |sumRe^-|$$

$$Q = \frac{\left(1 - \frac{|sumRe^-|}{sumRe^+}\right)(sumRe^+)^2 + \left(1 - \frac{|sumIm^-|}{sumIm^+}\right)(sumIm^+)^2}{(sumRe^+)^2 + (sumIm^+)^2}$$

$$sumIm^+ \geq |sumIm^-|,$$

$$sumRe^+ < |sumRe^-|$$

$$Q = \frac{\left(1 - \frac{sumRe^+}{|sumRe^-|}\right)(|sumRe^-|)^2 + \left(1 - \frac{|sumIm^-|}{sumIm^+}\right)(sumIm^+)^2}{(|sumRe^-|)^2 + (sumIm^+)^2}$$

$$sumIm^+ < |sumIm^-|,$$

$$sumRe^+ \geq |sumRe^-|$$

$$Q = \frac{\left(1 - \frac{|sumRe^-|}{sumRe^+}\right)(sumRe^+)^2 + \left(1 - \frac{sumIm^+}{|sumIm^-|}\right)(|sumIm^-|)^2}{(sumRe^+)^2 + (|sumIm^-|)^2}$$

-continued $$sumIm^+ < |sumIm^-|,$$

$$sumRe^+ < |sumRe^-|$$

$$Q = \frac{\left(1 - \frac{sumRe^+}{|sumRe^-|}\right)(|sumRe^-|)^2 + \left(1 - \frac{sumIm^+}{|sumIm^-|}\right)(|sumIm^-|)^2}{(|sumRe^-|)^2 + (|sumIm^-|)^2}$$

The four case differentiations are made so that Q can take values between 0 and 1.

Loudness Preservation-Mapping 613—Alternative 1:

In the following, the mapping procedure (which may be performed by the mapping block 613) is exemplarily calculated for the case of energy preservation. However, it should be noted that different mapping equations are possible.

If the gain value Q is applied directly to the reference magnitude, it will reduce its energy (for example, if the gain value Q is in a range between 0 and 1). This may reduce the perceived loudness of the mixed signal.

According to an aspect of the invention, the energy loss is therefore tracked and time-delayed fed back to the signal. It is important not to revert the reduction of the reference magnitude 612 that has been previously carried out, by this second step 613. The energy can only be fed back if the reduction of the reference magnitude was not too high. Specifically, these steps are executed:

- Tracking of the cancellation degree over time by smoothing with p=[0−1]:

$$Q_{smooth}(t)=p*Q_{smooth}(t-1)+(p-1)*Q(t)$$

- Mapping of Q above the upper limit of its value range to allow values above 1 and thus amplification:

$$Q_{mapped}(t)=(Q(t)+1)^{(Q_{smooth}(t)^{-T})}-1$$

However, is should be noted that different tracking equations and/or methods are possible.

However, the following comments should be noted:

It has been found that, with the constant value T=0.6, a mapping of the value range of Q can be achieved which compensates the energy loss in average. It should be noted that the value of the exponent T was determined empirically from a signal database of more than 125 audio signals. For this purpose, the energy of the reference magnitude was summed up over all bands (in the audible range) and compared with the summed energy of the modified magnitude processed with $Q_{mapped}$ and the difference was minimized over T. However, the exponent T can still be changed, if a different mapping effect is desired.

Moreover, it should be noted that, the smaller Q, the less it is mapped upwards. Artifacts are not amplified.

Also, the larger Q, the more it is mapped upwards and can reach values above 1.

In some embodiments, this ensures that the more reliable the phase information at a time, the more energy is fed back into the signal. However, in some embodiments, it may be useful to limit the amount of the fed back energy to avoid excessive amplifications. For example, $Q_{mapped}$ may be limited to a certain value, for example, 1.2, 1.5, 1.8 or 2.0.

Loudness Preservation-Mapping 613—Alternative 2:

In the following, an alternative implementation of the loudness preservation-mapping 613 will be described.

In the following the mapping procedure is exemplarily calculated for the case of energy preservation. However, different mapping equations are possible.

If Q is applied directly to the reference magnitude it will reduce its energy. This may reduce the perceived loudness of the mixed signal. The energy loss therefore is tracked and time-delayed fed back to the signal. It is important not to revert the reduction of the reference magnitude (for example, in block 612)] that has been carried out previously, by this second step (for example, in block 613). The energy can only be fed back if the reduction of the reference magnitude was not too high.

Specifically, these steps are executed:

Tracking of the cancellation degree over time by smoothing with p=[0−1]:

$$Q_{smooth}(t)=p*Q_{smooth}(t-1)+(p-1)*Q(t)$$

However, different tracking equations/methods are possible.

(Satiable) Mapping of Q towards the value 1 and thus without amplifying the reference magnitude [212]:

$$m_{slope}(t)=\max\{G*Q_{smooth}(t)-1,1\}$$

$$Q_{mapped}(t)=\min\{m_{slope}(t)*Q(t),1\}$$

Generally speaking, this type of mapping tries to preserve the original reference magnitude and only attenuates it if stronger destructive interferences are detected. Although there is no amplification, the perceived overall loudness is not changed. The attenuation of the reference magnitude, due to the stronger destructive interferences is mostly masked by the signal.

The following comments should advantageously be considered:

The constant gain G is the strength of the slope and can, for example, take values between 1 and 10 (or between 0.5 and 20).

The slope $m_{slope}(t)$ depends on the average of the cancellation degree:

The smaller $Q_{smooth}(t)$, the more cautious is the mapping, in order not to amplify potential artifacts.

The larger $Q_{smooth}(t)$, the stronger the mapping.

Figure 11:
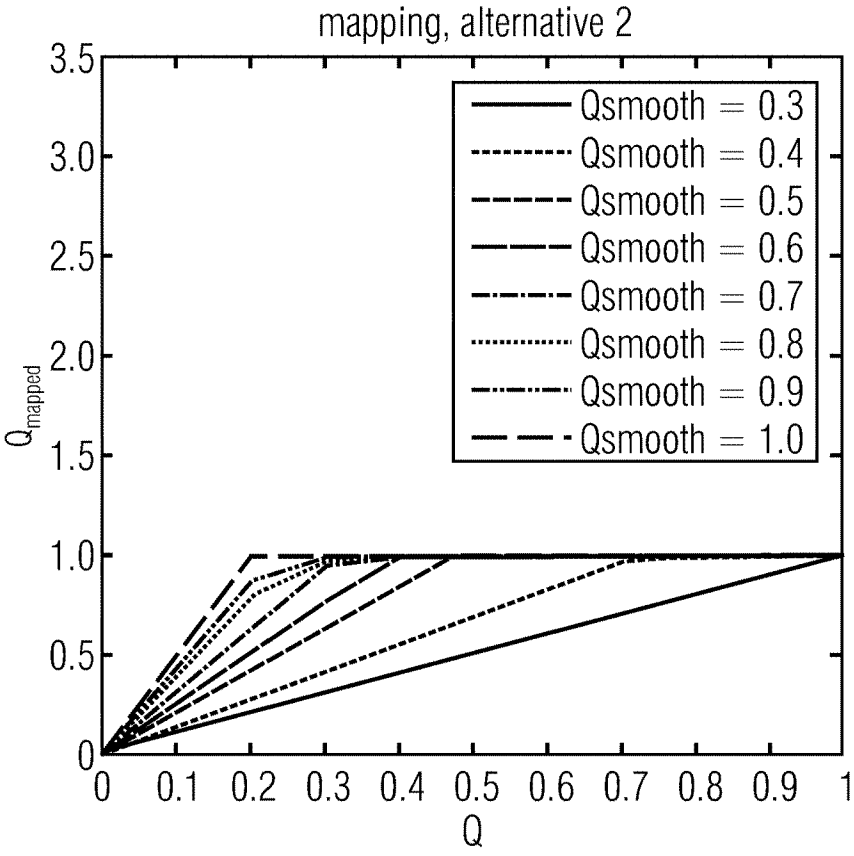
FIG. 11 shows a graphic representation of examples of mapping curves which can be achieved using the different mapping concepts for the loudness preservation described herein.
Figure 11:
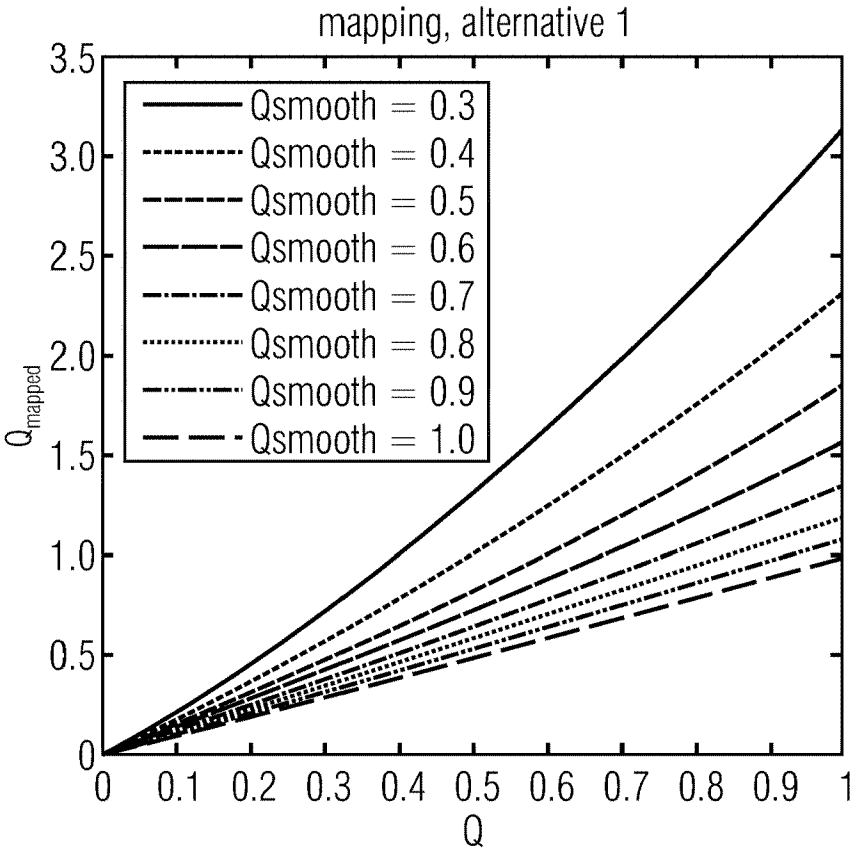

FIG. 11 shows examples of mapping curves which can be achieved using the different mapping concepts for the loudness preservation described herein.

In the mapping according to the first alternative, amplifications larger than 1 are allowed, such that missing energy is introduced (fed back) into the signal in a time-delayed manner using $Q_{mapped}$.

In the mapping according to the second alternative, no amplification is allowed. Rater, it is tried to maintain as much as possible of the reference magnitude, thus not to scale down (or reduce) the reference magnitude. The reference magnitude is only decreased or scaled down if strong destructive interference occurs. Also, the degree of decrease (or of scaling down) is still dependent on $Q_{smooth}$, i.e. from the energy lost over time.

6. Downmixer According to FIG. 8

FIG. 8 shows a block schematic diagram of a downmixer, according to another embodiment of the present invention.

The downmixer 800 is similar to the downmixer 500, such that identical features, functionalities and signals will not be described here again. Rather, identical reference numerals will be used like in the discussion of the downmixer 500 and reference is made to the above explanations regarding the downmixer 500.

However, in addition to the functionalities and/or blocks of the downmixer 500, the downmixer 800 also comprises a phase correction value calculation 814, which receives the complex-valued representation 501*a* to 501*n* of the input signals (or of the spectral bins thereof). Moreover, the phase correction value calculation 814 may also receive the phase value 508*a*. The phase correction value calculation 814 also provides a phase correction value 815 to the combiner 510, such that the combiner 510 derives the modified phase value 510*a* on the basis of the phase value 508*a*, taking into consideration the phase correction value 815 (which is also designated with W).

Accordingly, the phase correction value calculation 814 may, for example, determine when the phase value 508*a*, which may be obtained by the simple phase calculation 508 described above, deviates from an actual phase value strongly or when the phase value 508*a* comprises excessive phase jumps or the like.

For example, the phase correction value calculation 814 may provide the phase correction value 815 such that there is a smooth fade-over between phase values provided by the phase calculation 508*a* and corrected phase values 510*a*. For example, the phase correction value calculation 814 may provide the phase correction value 815 such that the phase correction value 815 smoothly transitions from zero to a desired phase correction value.

However, it should be noted that, in some embodiments, the summers/combiners 507*a*, 507*c*, the phase calculation 508, the phase correction value calculation 814 and the combination 510 can be replaced by an improved phase value calculation, which commonly computes phase values having increased reliability.

For example, a phase value determination as shown in FIG. 3 may be used permanently, or may be used for the provision of phase correction values 815, depending on the requirements.

Loudness Downmix with Adaptive Phase

In the following, a loudness downmix with adaptive phase will be described, which can be used according to an aspect of the invention.

In order to be able to use the reference magnitude $M_R$ continuously, "reliable" phase response is needed. For this purpose, the right wing in FIG. 5 (and also in FIG. 8) is activated (shown in blue/dashed lines or lines labeled "optional phase modification"). In a step or functional block "phase correction value calculation" 814, a phase correction value 815 (also designated with W) is calculated based on the branched-off input signals (for example, on the basis of the number representations 501*a* to 501*n*). The potential erroneous phase of the passive downmix, for example, the "passive downmix phase $P_P$ 508 a", is corrected in such a way, so that noticeable artifacts (based phase jumps) are avoided.

The module (or functional block, or functionality) "phase correction value calculation" 814 can consist of several sub modules. In case of no destructive interferences of the input signals during the passive downmix, the phase correction value is close to zero. As soon as destructive interferences/cancellations occur, a value (e.g. phase correction value) is calculated that results in a reliable phase response.

The reliable phase response is retrieved, for example, from an adaptively weighted summation of the input signals. For example, it may be needed to track the loudness values of the individual signals over time. The adaptive weighting aims to create a DMX (sub-mix) without disturbing destructive interferences. In the sub-mix, destructive interferences can be tolerated to a certain extent. This can be useful to avoid artificially generated phase jumps when reweighting the individual input signals.

In order to ensure smooth transitions while switching between passive downmix (DMX) and sub-mix, phase correction can also be applied when no destructive interferences/cancellations occur. Optionally, it is possible to the smooth the phase responses over several frequency bands in order to additionally attenuate phase jumps.

To conclude, FIG. 8 shows a block schematic diagram of a downmixer which uses a loudness downmix with adaptive phase.

For example, in the embodiment according to FIG. 8, the cancellation degree calculation 612 and the mapping 613 may be inactive (or absent), but the phase correction value calculation 814 may be active.

However, in some embodiments, it is also possible to use the cancellation degree calculation 612 and the mapping 613, as well as the phase correction value calculation 814, at the same time, to thereby obtain good results.

However, it should be noted that the embodiment according to FIG. 8 can be supplemented by any of the features, functionalities and details disclosed herein, both individually and taking in combination.

7. Conclusions and General Remarks

To conclude, it should be noted that concepts have been described which help to reduce artifacts when providing a downmix signal on the basis of a plurality of input signals. In particular, the problems arising from cancellations have been addressed. For example, as soon as two or more pointers (or phasers or vectors) lie outside of an angle area of 90°, there are cancellations on one or even on both axes of the coordinate system. That means, that either real components or imaginary components of the pointers (or phasers or vectors) (or both) cancel out partially or even completely. Thus, one can speak of destructive interference/superposition. Thus, the question whether there is destructive interference or superposition is independent from the length of a sum vector, and also independent from the question whether the length of a sum vector is longer than a longer one of the two vectors.

As an additional remark, it should be noted that interferences are only considered in a temporal average, because the processing typically takes place in a frequency domain and as typically signal buffers of certain length are analyzed. It should be noted that it may happen that, within a signal buffer (when considering a temporal signal structure) there are constructive and destructive interferences at the same time. However, in the frequency domain, one only sees which type of interference over weights in the buffer. Thus, the buffer is classified accordingly. Thus, it should be noted that the question whether there is constructive or destructive interference can be judged as described herein. Also, proper corrections of the amplitude and/or of the phase can be made, for example, when it is found that the phase value would be unreliable in view of the interferences.

8. Method According to FIG. 9

Figure 9:
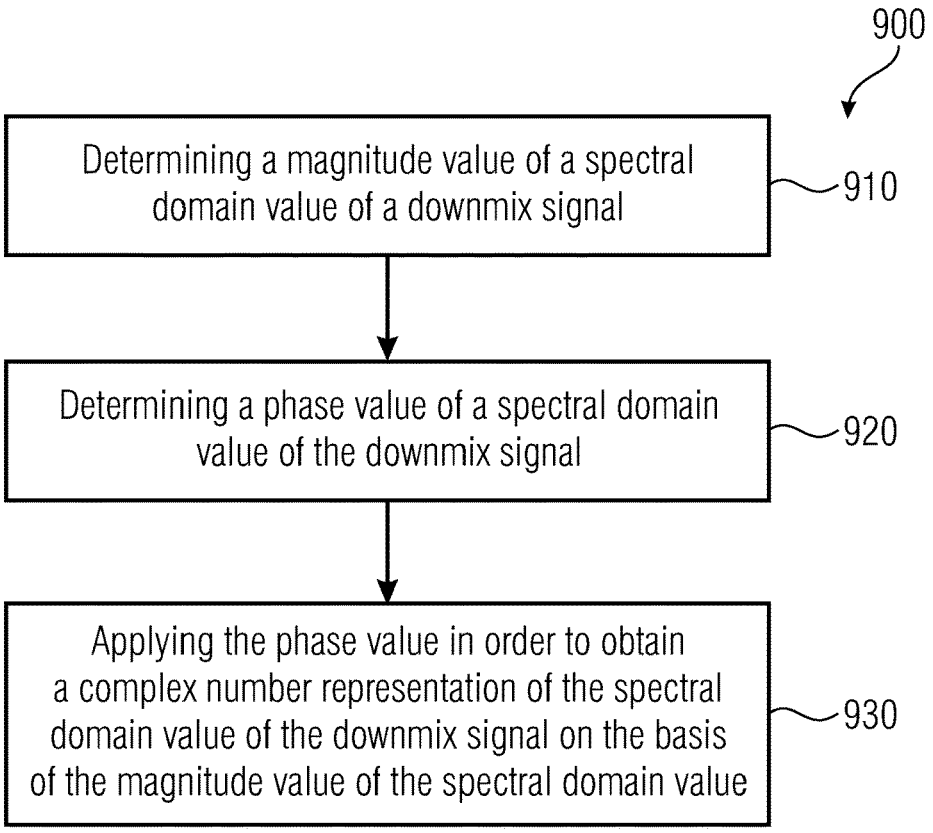
FIG. 9 shows a flowchart of a method for providing a downmix signal, according to an embodiment of the invention.

FIG. 9 shows a flow chart of a method 900 for providing a downmix signal on the basis of a plurality of input signals, according to an embodiment of the invention.

The method 900 comprises determining 910 a magnitude value of a spectral domain value of the downmix signal on the basis of a loudness information of the input signals, and the method 900 comprises determining 920 a phase value of a spectral domain value of the downmix signal. The method 900 also comprises applying 930 the phase value in order to obtain a complex number representation of the spectral domain value of the downmix signal on the basis of the magnitude value of the spectral domain value.

The method 900 can optionally be supplemented by any of the features, functionalities and details disclosed herein, both individually and taken in combination.

Also, it should be noted that steps 910 and 920 can naturally also be executed in parallel, if desired.

9. Audio Encoder According to FIG. 10

Figure 10:
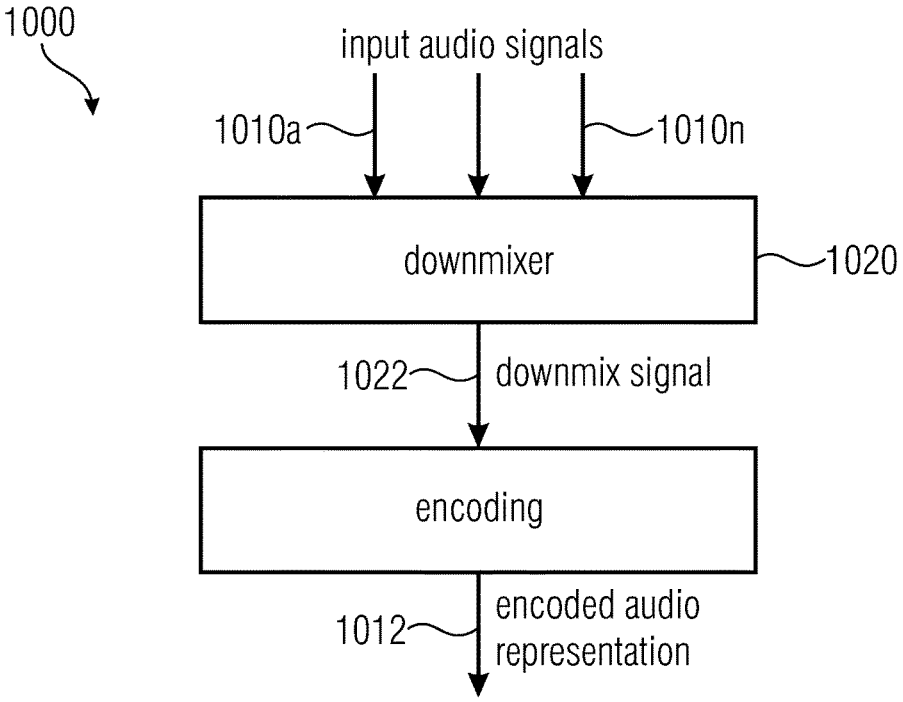
FIG. 10 shows a block schematic diagram of an audio encoder, according to an embodiment of the invention.

FIG. 10 shows a block schematic diagram of an audio encoder 1000, according to an embodiment of the present invention.

The audio encoder 1000 is configured for providing an encoded audio representation 1012 on the basis of a plurality of input audio signals 1010*a* to 1010*n*, The audio encoder comprises a downmixer 1020, which may correspond to any of the downmixers described above. The downmixer 1020 is configured to provide a downmix signal 1022 on the basis of (complex-valued) spectral domain representations of the plurality of input audio signals. Moreover, the audio encoder is configured to encode the downmix signal 1022, in order to obtain the encoded audio representation 1012.

The audio encoder may use any of the known encoding technologies in order to encode the downmix signal, like, for example, AAC-type encoding or LPC-based encoding. Also, the audio encoder may optionally provide additional side information describing the downmixing (for example, a weighting of input signals in the downmix signal) or any other side information known in the art of audio encoding.

10. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

The apparatus described herein may be implemented using a hardware apparatus, or using a computer, or using a combination of a hardware apparatus and a computer.

The apparatus described herein, or any components of the apparatus described herein, may be implemented at least partially in hardware and/or in software.

The methods described herein may be performed using a hardware apparatus, or using a computer, or using a combination of a hardware apparatus and a computer.

The methods described herein, or any components of the apparatus described herein, may be performed at least partially by hardware and/or by software.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

11. Further Conclusions

To further conclude, when downmixing an N-channel input signal, in order to obtain an M-channel output signal (N>M), unwanted effects can occur. These effects can manifest themselves in the form of sound colorization, ambience manipulation, decrease of speech intelligibility and other artifacts.

To overcome these effects, a loudness-preserving downmix may be processed for the magnitude and a non-adaptive downmix may be calculated for phase information retrievement, in parallel. Afterwards, magnitude and phase are merged together, to form the M-channel output signal.

These considerations can optionally be introduced into any of the embodiments disclosed herein.

The invention claimed is:

1. A downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to acquire a complex valued number representation of the spectral domain value of the downmix signal on the basis of the magnitude value of the spectral domain value of the downmix signal;

wherein the downmixer is configured to determine a sum or a weighted sum of complex-valued spectral domain values of the input signals and to determine the phase value on the basis of a real part and an imaginary part of the sum or on the basis of a real part and an imaginary part of the weighted sum of spectral domain values of the input signals.

2. The downmixer according to claim 1, wherein the downmixer is configured to determine the phase value of the spectral domain value of the downmix signal independently from the determination of the magnitude value of the spectral domain value of the downmix signal.

3. The downmixer according to claim 1, wherein the downmixer is configured to determine loudness values of spectral domain values of the input signals, and wherein the downmixer is configured to derive a sum loudness value associated with the spectral domain value of the downmix signal on the basis of the loudness values of the spectral domain values of the input signals; and wherein the downmixer is configured to derive the magnitude value of the spectral domain value of the downmix signal from the sum loudness value.

4. The downmixer according to claim 1, wherein the downmixer is configured to use the magnitude value of the spectral domain value of the downmix signal as an absolute value of a polar representation of the spectral domain value of the downmix signal and to use the phase value as a phase value of the polar representation of the spectral domain value of the downmix signal, and to acquire a cartesian complex-valued representation(511*a*,511*b*) of the spectral domain value of the downmix signal on the basis of the polar representation.

5. The downmixer according to claim 1, wherein the downmixer is configured to determine a cancellation degree information, and to consider the cancellation degree information in the determination of the magnitude value of a spectral domain value of the downmix signal, wherein the cancellation degree information describes a degree of constructive or destructive interference between spectral domain values of the input signals, and wherein the downmixer is configured to selectively reduce the magnitude value of the spectral domain value of the downmix signal when compared to a magnitude value representing a sum of loudness values of the spectral domain values of the input signals in case the cancellation degree information indicates a destructive interference.

6. The downmixer according to claim 5, wherein the downmixer is configured to determine separate sums of components of the spectral domain values of the input signals comprising different orientations, and wherein the downmixer is configured to determine the cancellation degree information on the basis of the separate sums of components of the spectral domain values of the input signals comprising different orientations.

7. The downmixer according to claim 6, wherein the downmixer is configured to select two of the determined sums, which are associated with orthogonal orientations, and which are larger than or equal to sums which are associated with opposite directions, as dominant sum values, and wherein the downmixer is configured to determine a scaling value, which causes a selective reduction of the magnitude value of the spectral domain value of the downmix signal on the basis of a non-signed ratio between a first non-dominant sum value, which is associated with an orientation opposite to an orientation of a first dominant sum value, and the first dominant sum value, and a non-signed ratio between a second non-dominant sum value, which is associated with an orientation opposite to an orientation of a second dominant sum value, and the second dominant sum value, such that increasing non-signed ratios between a non-dominant sum value and its associated dominant sum value result in a reduction of the magnitude value of the spectral domain value of the downmix signal.

8. The downmixer according to claim 5, wherein the downmixer is configured to calculate the cancellation degree information Q according to the following equations:

if $sumIm^+ \geq |sumIm^-|$ and $sumRe^+ \geq |sumRe^-|$:

$$Q = \frac{\left(1 - \frac{|sumRe^-|}{sumRe^+}\right)(sumRe^+)^2 + \left(1 - \frac{|sumIm^-|}{sumIm^+}\right)(sumIm^+)^2}{(sumRe^+)^2 + (sumIm^+)^2}$$

if $sumIm^+ \geq |sumIm^-|$ and $sumRe^+ < |sumRe^-|$:

$$Q = \frac{\left(1 - \frac{sumRe^+}{|sumRe^-|}\right)(|sumRe^-|)^2 + \left(1 - \frac{|sumIm^-|}{sumIm^+}\right)(sumIm^+)^2}{(|sumRe^-|)^2 + (sumIm^+)^2}$$

if $sumIm^+ < |sumIm^-|$ and $sumRe^+ \geq |sumRe^-|$:

$$Q = \frac{\left(1 - \frac{|sumRe^-|}{sumRe^+}\right)(sumRe^+)^2 + \left(1 - \frac{sumIm^+}{|sumIm^-|}\right)(|sumIm^-|)^2}{(sumRe^+)^2 + (|sumIm^-|)^2}$$

if $sumIm^+ < |sumIm^-|$ and $sumRe^+ < |sumRe^-|$:

$$Q = \frac{\left(1 - \frac{sumRe^+}{|sumRe^-|}\right)(|sumRe^-|)^2 + \left(1 - \frac{sumIm^+}{|sumIm^-|}\right)(|sumIm^-|)^2}{(|sumRe^-|)^2 + (|sumIm^-|)^2}$$

wherein sumRe+ is a sum of positive real parts of complex-valued spectral domain values of the input audio signals;

wherein sumRe− is a sum of negative real parts of complex-valued spectral domain values of the input audio signals;

wherein sumlm+ is a sum of positive imaginary parts of complex-valued spectral domain values of the input audio signals; and wherein sumlm− is a sum of negative imaginary parts of complex-valued spectral domain values of the input audio signals.

9. The downmixer according to claim 1, wherein the downmixer is configured to determine the magnitude value of the spectral domain value of the downmix signal such that the magnitude value is selectively reduced with respect to a reference value, which corresponds to a sum loudness of spectral domain values of the input signals, at time instances at which a cancellation degree information determined by the downmixer indicates a comparatively large destructive interference between the input signals, and such that the magnitude value is selectively increased with respect to the reference value at time instances at which the cancellation degree information indicates a comparatively small destructive interference between the input signals.

10. The downmixer according to claim 9, wherein the downmixer is configured to track the cancellation degree information) over time, and to determine, in dependence on a history of the cancellation degree information, by how much the magnitude value is selectively increased with respect to the reference value at time instances at which the cancellation degree information indicates a comparatively small destructive interference between the input signals.

11. The downmixer according to claim 9, wherein the downmixer is configured to acquire a temporally smoothened cancellation degree information) on the basis of an instant cancellation degree information) using an infinite-impulse-response smoothing operation or using a sliding average smoothing operation, in order to track the cancellation degree information.

12. The downmixer according to claim 9, wherein the downmixer is configured to map an instant cancellation degree value) onto a mapped cancellation degree value in dependence on the temporally smoothened cancellation degree information), such that a value of the temporally smoothened cancellation degree information indicating a reduction of the magnitude value results in an increase of the mapped cancellation degree value over the instant cancellation degree value.

13. The downmixer according to claim 1, wherein the downmixer is configured to acquire an updated smoothened cancellation degree value Qsmooth(t) on the basis of a previous smoothened cancellation degree value Qsmooth(t−1) and on the basis of an instant cancellation degree value Q(t) according to $$Q_{smooth}(t)=p*Q_{smooth}(t-1)+(p-1)*Q(t)$$

wherein p is a constant with 0<p<1;

and wherein the downmixer is configured to acquire a mapped cancellation degree value Qmapped according to $$Q_{mapped}(t)=(Q(t)+1)^{(Q_{smooth}(t)^{T})}-1$$

wherein T is a constant with 0<T<1;

wherein Q(t) is in a range between 0 and 1 and takes a value of 0 for a comparatively large destructive interference between the input signals and takes a value of 1 for a comparatively small destructive interference between the input signals;

wherein the downmixer is configured to scale a reference magnitude value using the mapped cancellation degree value, to acquire the magnitude value.

14. The downmixer according to claim 1, wherein the downmixer is configured to acquire an updated smoothened cancellation degree value Qsmooth(t) on the basis of a previous smoothened cancellation degree value Qsmooth(t−1) and on the basis of an instant cancellation degree value Q(t) according to $$Q_{smooth}(t)=Q_{smooth}(t-1)+(p-1)*Q(t)$$

wherein p is a constant with 0<=p<=1;

and wherein the downmixer is configured to acquire a mapped cancellation degree value Qmapped according to $$m_{slope}(t)=\max\{G*Q_{smooth}(t)-1,1\}$$

$$Q_{mapped}(t)=\min\{m_{slope}(t)*Q(t),1\}$$

wherein G is a predetermined value or a constant value between 0.5 and 20 or between 1 and 10;

wherein $m_{slope}(t)$ is an auxiliary variable;

wherein max{ } is a maximum operator;

wherein min{ } is a minimum operator;

wherein Q(t) is in a range between 0 and 1 and takes a value of 0 for a comparatively large destructive interference between the input signals and takes a value of 1 for a comparatively small destructive interference between the input signals;

wherein the downmixer is configured to scale a reference magnitude value using the mapped cancellation degree value, to acquire the magnitude value.

15. The downmixer according to claim 1, wherein the downmixer is configured to scale a magnitude value, which corresponds to a sum loudness of spectral domain values of the input signals, using a cancellation degree value, to acquire the magnitude value of the spectral domain value of the downmix signal.

16. The downmixer according to claim 1, wherein the downmixer is configured to determine a weighted sum of spectral domain values of the input signals and to determine the phase value on the basis of the weighted sum of spectral domain values of the input signals, wherein the downmixer is configured to weight spectral domain values of the input signals in such a way to avoid destructive interference which is larger than a predetermined interference level, to acquire the weighted sum.

17. The downmixer according to claim 1, wherein the downmixer is configured to determine a weighted sum of spectral domain values of the input signals and to determine the phase value on the basis of the weighted sum of spectral domain values of the input signals, wherein the downmixer is configured to weight spectral domain values of the input signals in dependence on a time-averaged intensity of the respective spectral bin in different input signals, to acquire the weighted sum.

18. An audio encoder for providing an encoded audio representation on the basis of a plurality of input audio signals, wherein the audio encoder comprises a downmixer according to claim 1, wherein the downmixer is configured to provide a downmix signal on the basis of spectral domain representations of the plurality of input audio signals, and wherein the audio encoder is configured to encode the downmix signal, in order to acquire the encoded audio representation.

19. A method for providing a downmix signal on the basis of a plurality of input signals, wherein the method comprises determining a magnitude value of a spectral domain value of the downmix signal on the basis of a loudness information of the input signals, and wherein the method comprises determining a phase value of a spectral domain value of the downmix signal; and wherein the method comprises applying the phase value in order to acquire a complex number representation of the spectral domain value of the downmix signal on the basis of the magnitude value of the spectral domain value, wherein the method comprises determining a sum or a weighted sum of complex-valued spectral domain values of the input signals, and determining the phase value on the basis of a real part and an imaginary part of the sum or on the basis of a real part and an imaginary part of the weighted sum of spectral domain values of the input signals.

20. A non-transitory digital storage medium having stored thereon a computer program for performing a method for providing a downmix signal on the basis of a plurality of input signals, wherein the method comprises determining a magnitude value of a spectral domain value of the downmix signal on the basis of a loudness information of the input signals, and wherein the method comprises determining a phase value of a spectral domain value of the downmix signal; and wherein the method comprises applying the phase value in order to acquire a complex number representation of the spectral domain value of the downmix signal on the basis of the magnitude value of the spectral domain value, wherein the method comprises determining a sum or a weighted sum of complex-valued spectral domain values of the input signals, and determining the phase value on the basis of a real part and an imaginary part of the sum or on the basis of a real part and an imaginary part of the weighted sum of spectral domain values of the input signals, when said computer program is run by a computer.

21. A downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to acquire a complex valued number representation of the spectral domain value of the downmix signal on the basis of the magnitude value of the spectral domain value of the downmix signal;

wherein the downmixer is configured to determine a cancellation degree information, and to consider the cancellation degree information in the determination of the magnitude value of a spectral domain value of the downmix signal, wherein the cancellation degree information describes a degree of constructive or destructive interference between spectral domain values of the input signals, and wherein the downmixer is configured to scale a magnitude value representing a sum of loudness values of the spectral domain values of the input signals in dependence on the cancellation degree information, to selectively reduce the magnitude value of the spectral domain value of the downmix signal when compared to a magnitude value representing a sum of loudness values of the spectral domain values of the input signals in case the cancellation degree information indicates a destructive interference.

22. A downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to acquire a complex valued number representation of the spectral domain value of the downmix signal on the basis of the magnitude value of the spectral domain value of the downmix signal;

wherein the downmixer is configured to determine a cancellation degree information, and to consider the cancellation degree information in the determination of the magnitude value of a spectral domain value of the downmix signal, wherein the cancellation degree information describes a degree of constructive or destructive interference between spectral domain values of the input signals, and wherein the downmixer is configured to selectively reduce the magnitude value of the spectral domain value of the downmix signal when compared to a magnitude value representing a sum of loudness values of the spectral domain values of the input signals in case the cancellation degree information indicates a destructive interference;

wherein the downmixer is configured to determine sums of components of the spectral domain values of the input signals comprising different orientations, and wherein the downmixer is configured to determine the cancellation degree information on the basis of the sums of components of the spectral domain values of the input signals comprising different orientations;

wherein the downmixer is configured to select two of the determined sums, which are associated with orthogonal orientations, and which are larger than or equal to sums which are associated with opposite directions, as dominant sum values, and wherein the downmixer is configured to determine a scaling value, which causes a selective reduction of the magnitude value of the spectral domain value of the downmix signal on the basis of a non-signed ratio between a first non-dominant sum value, which is associated with an orientation opposite to an orientation of a first dominant sum value, and the first dominant sum value, and a non-signed ratio between a second non-dominant sum value, which is associated with an orientation opposite to an orientation of a second dominant sum value, and the second dominant sum value, such that increasing non-signed ratios between a non-dominant sum value and its associated dominant sum value result in a reduction of the magnitude value of the spectral domain value of the downmix signal.

23. A downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to acquire a complex valued number representation of the spectral domain value of the downmix signal on the basis of the magnitude value of the spectral domain value of the downmix signal;

wherein the downmixer is configured to determine a cancellation degree information, and to consider the cancellation degree information in the determination of the magnitude value of a spectral domain value of the downmix signal, wherein the cancellation degree information describes a degree of constructive or destructive interference between spectral domain values of the input signals, and wherein the downmixer is configured to selectively reduce the magnitude value of the spectral domain value of the downmix signal when compared to a magnitude value representing a sum of loudness values of the spectral domain values of the input signals in case the cancellation degree information indicates a destructive interference;

wherein the downmixer is configured to calculate the cancellation degree information Q according to the following equations:

if $sumIm^{+} \geq |sumIm^{-}|$ and $sumRe^{+} \geq |sumRe^{-}|$:

$$Q = \frac{\left(1 - \frac{|sumRe^{-}|}{sumRe^{+}}\right)(sumRe^{+})^2 + \left(1 - \frac{|sumIm^{-}|}{sumIm^{+}}\right)(sumIm^{+})^2}{(sumRe^{+})^2 + (sumIm^{+})^2}$$

if $sumIm^{+} \geq |sumIm^{-}|$ and $sumRe^{+} < |sumRe^{-}|$:

$$Q = \frac{\left(1 - \frac{sumRe^{+}}{|sumRe^{-}|}\right)(|sumRe^{-}|)^2 + \left(1 - \frac{|sumIm^{-}|}{sumIm^{+}}\right)(sumIm^{+})^2}{(|sumRe^{-}|)^2 + (sumIm^{+})^2}$$

if $sumIm^{+} < |sumIm^{-}|$ and $sumRe^{+} \geq |sumRe^{-}|$:

$$Q = \frac{\left(1 - \frac{|sumRe^{-}|}{sumRe^{+}}\right)(sumRe^{+})^2 + \left(1 - \frac{sumIm^{+}}{|sumIm^{-}|}\right)(|sumIm^{-}|)^2}{(sumRe^{+})^2 + (|sumIm^{-}|)^2}$$

-continued if $sumIm^{+} < |sumIm^{-}|$ and $sumRe^{+} < |sumRe^{-}|$:

$$Q = \frac{\left(1 - \frac{sumRe^{+}}{|sumRe^{-}|}\right)(|sumRe^{-}|)^2 + \left(1 - \frac{sumIm^{+}}{|sumIm^{-}|}\right)(|sumIm^{-}|)^2}{(|sumRe^{-}|)^2 + (|sumIm^{-}|)^2}$$

wherein sumRe+ is a sum of positive real parts of complex-valued spectral domain values of the input audio signals;

wherein sumRe− is a sum of negative real parts of complex-valued spectral domain values of the input audio signals;

wherein sumIm+ is a sum of positive imaginary parts of complex-valued spectral domain values of the input audio signals; and wherein sumIm− is a sum of negative imaginary parts of complex-valued spectral domain values of the input audio signals.

24. A downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to acquire a complex valued number representation of the spectral domain value of the downmix signal on the basis of the magnitude value of the spectral domain value of the downmix signal;

wherein the downmixer is configured to determine a reference magnitude value on the basis of a plurality of input signals; and wherein the downmixer is configured to scale the reference magnitude value, which is unaffected by constructive and destructive interference of the input signals, to determine the magnitude value of the spectral domain value of the downmix signal such that the magnitude value is selectively reduced with respect to a reference value, which corresponds to a sum loudness of spectral domain values of the input signals, at time instances at which a cancellation degree information determined by the downmixer indicates a comparatively large destructive interference between the input signals, and such that the magnitude value is selectively increased with respect to the reference value at time instances at which the cancellation degree information indicates a comparatively small destructive interference between the input signals.

25. A downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to acquire a complex valued number representation of the spectral domain value of the downmix signal on the basis of the magnitude value of the spectral domain value of the downmix signal;

wherein the downmixer is configured to acquire an updated smoothened cancellation degree value Qsmooth(t) on the basis of a previous smoothened cancellation degree value Qsmooth(t−1) and on the basis of an instant cancellation degree value Q(t) according to $$Q_{smooth}(t)=p*Q_{smooth}(t-1)+(p-1)*Q(t)$$

wherein p is a constant with 0<p<1;

and wherein the downmixer is configured to acquire a mapped cancellation degree value Qmapped according to $$Q_{mapped}(t)=(Q(t)+1)^{(Q_{smooth}(t)^{T})}-1$$

wherein T is a constant with 0<T<1;

wherein Q(t) is in a range between 0 and 1 and takes a value of 0 for a comparatively large destructive interference between the input signals and takes a value of 1 for a comparatively small destructive interference between the input signals;

wherein the downmixer is configured to scale a reference magnitude value using the mapped cancellation degree value, to acquire the magnitude value.

26. A downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to acquire a complex valued number representation of the spectral domain value of the downmix signal on the basis of the magnitude value of the spectral domain value of the downmix signal;

wherein the downmixer is configured to acquire an updated smoothened cancellation degree value Qsmooth(t) on the basis of a previous smoothened cancellation degree value Qsmooth(t−1) and on the basis of an instant cancellation degree value Q(t) according to $$Q_{smooth}(t)=p*Q_{smooth}(t-1)+(p-1)*Q(t)$$

wherein p is a constant with 0<=p<=1;

and wherein the downmixer is configured to acquire a mapped cancellation degree value Qmapped according to $$m_{slope}(t)=\max\{G*Q_{smooth}(t)-1,1\}$$

$$Q_{mapped}(t)=\min\{m_{slope}(t)*Q(t),1\}$$

wherein G is a predetermined value or a constant value between 0.5 and 20 or between 1 and 10;

wherein $m_{slope}(t)$ is an auxiliary variable;

wherein max{ } is a maximum operator;

wherein min{ } is a minimum operator;

wherein Q(t) is in a range between 0 and 1 and takes a value of 0 for a comparatively large destructive interference between the input signals and takes a value of 1 for a comparatively small destructive interference between the input signals;

wherein the downmixer is configured to scale a reference magnitude value using the mapped cancellation degree value, to acquire the magnitude value.

27. A downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to acquire a complex valued number representation of the spectral domain value of the downmix signal on the basis of the magnitude value of the spectral domain value of the downmix signal;

wherein the downmixer is configured to determine a weighted sum of spectral domain values of the input signals and to determine the phase value on the basis of the weighted sum of spectral domain values of the input signals, wherein the downmixer is configured to weight spectral domain values of the input signals in such a way to avoid destructive interference which is larger than a predetermined interference level, to acquire the weighted sum;

wherein the downmixer is configured to determine loudness values of spectral domain values of the input signals, and wherein the downmixer is configured to derive a sum loudness value associated with the spectral domain value of the downmix signal on the basis of the loudness values of the spectral domain values of the input signals; and wherein the downmixer is configured to derive the magnitude value of the spectral domain value of the downmix signal from the sum loudness value.

28. A downmixer for providing a downmix signal on the basis of a plurality of input signals, wherein the downmixer is configured to determine a magnitude value of a spectral domain value of the downmix signal on the basis of a loudness information of the input signals, and wherein the downmixer is configured to determine a phase value of the spectral domain value of the downmix signal; and wherein the downmixer is configured to apply the phase value in order to acquire a complex valued number representation of the spectral domain value of the downmix signal on the basis of the magnitude value of the spectral domain value of the downmix signal;

wherein the downmixer is configured to determine a weighted sum of spectral domain values of the input signals and to determine the phase value on the basis of the weighted sum of spectral domain values of the input signals, wherein the downmixer is configured to weight spectral domain values of the input signals in dependence on a time-averaged intensity of the respective spectral bin in different input signals using weighting values, to acquire the weighted sum;

wherein the downmixer is configured to determine loudness values of spectral domain values of the input signals, and wherein the downmixer is configured to derive a sum loudness value associated with the spectral domain value of the downmix signal on the basis of the loudness values of the spectral domain values of the input signals; and wherein the downmixer is configured to derive the magnitude value of the spectral domain value of the downmix signal from the sum loudness value;

wherein the downmixer is configured to form an average over spectral domain values of a plurality of spectral bins of a first of the input signals which are associated with the same frequency and which are associated with subsequent times, to acquire a first of the weighting values for the first input signal, and wherein the downmixer is configured to form an average over spectral domain values of a plurality of spectral bins of a second of the input signals which are associated with the same frequency and which are associated with subsequent times, to acquire a second of the weighting values for the second input signal.

29. A method for providing a downmix signal on the basis of a plurality of input signals, wherein the method comprises determining a magnitude value of a spectral domain value of the downmix signal on the basis of a loudness information of the input signals, and wherein the method comprises determining a phase value of the spectral domain value of the downmix signal; and wherein the method comprises applying the phase value in order to acquire a complex valued number representation of the spectral domain value of the downmix signal on the basis of the magnitude value of the spectral domain value of the downmix signal;

wherein the method comprises determining a cancellation degree information, and considering the cancellation degree information in the determination of the magnitude value of a spectral domain value of the downmix signal, wherein the cancellation degree information describes a degree of constructive or destructive interference between spectral domain values of the input signals, and wherein the method comprises scaling a magnitude value representing a sum of loudness values of the spectral domain values of the input signals in dependence on the cancellation degree information, to selectively reduce the magnitude value of the spectral domain value of the downmix signal when compared to a magnitude value representing a sum of loudness values of the spectral domain values of the input signals in case the cancellation degree information indicates a destructive interference.

30. A method for providing a downmix signal on the basis of a plurality of input signals, wherein the method comprises determining a magnitude value of a spectral domain value of the downmix signal on the basis of a loudness information of the input signals, and wherein the method comprises determining a phase value of the spectral domain value of the downmix signal; and wherein the method comprises applying the phase value in order to acquire a complex valued number representation of the spectral domain value of the downmix signal on the basis of the magnitude value of the spectral domain value of the downmix signal;

wherein the method comprises determining a cancellation degree information, and considering the cancellation degree information in the determination of the magnitude value of a spectral domain value of the downmix signal, wherein the cancellation degree information describes a degree of constructive or destructive interference between spectral domain values of the input signals, and wherein the method comprises selectively reducing the magnitude value of the spectral domain value of the downmix signal when compared to a magnitude value representing a sum of loudness values of the spectral domain values of the input signals in case the cancellation degree information indicates a destructive interference;

wherein the method comprises determining sums of components of the spectral domain values of the input signals comprising different orientations, and wherein the method comprises determining the cancellation degree information on the basis of the sums of components of the spectral domain values of the input signals comprising different orientations;

wherein the method comprises selecting two of the determined sums, which are associated with orthogonal orientations, and which are larger than or equal to sums which are associated with opposite directions, as dominant sum values, and wherein the method comprises determining a scaling value, which causes a selective reduction of the magnitude value of the spectral domain value of the downmix signal on the basis of a non-signed ratio between a first non-dominant sum value, which is associated with an orientation opposite to an orientation of a first dominant sum value, and the first dominant sum value, and a non-signed ratio between a second non-dominant sum value, which is associated with an orientation opposite to an orientation of a second dominant sum value, and the second dominant sum value, such that increasing non-signed ratios between a non-dominant sum value and its associated dominant sum value result in a reduction of the magnitude value of the spectral domain value of the downmix signal.

31. A method for providing a downmix signal on the basis of a plurality of input signals, wherein the method comprises determining a magnitude value of a spectral domain value of the downmix signal on the basis of a loudness information of the input signals, and wherein the method comprises determining a phase value of the spectral domain value of the downmix signal; and wherein the method comprises applying the phase value in order to acquire a complex valued number representation of the spectral domain value of the downmix signal on the basis of the magnitude value of the spectral domain value of the downmix signal;

wherein the method comprises determining a cancellation degree information, and considering the cancellation degree information in the determination of the magnitude value of a spectral domain value of the downmix signal, wherein the cancellation degree information describes a degree of constructive or destructive interference between spectral domain values of the input signals, and wherein the method comprises selectively reducing the magnitude value of the spectral domain value of the downmix signal when compared to a magnitude value representing a sum of loudness values of the spectral domain values of the input signals in case the cancellation degree information indicates a destructive interference;

wherein the method comprises calculating the cancellation degree information Q according to the following equations:

if $sumIm^+ \geq |sumIm^-|$ and $sumRe^+ \geq |sumRe^-|$:

$$Q = \frac{\left(1 - \frac{|sumRe^-|}{sumRe^+}\right)(sumRe^+)^2 + \left(1 - \frac{|sumIm^-|}{sumIm^+}\right)(sumIm^+)^2}{(sumRe^+)^2 + (sumIm^+)^2}$$

if $sumIm^+ \geq |sumIm^-|$ and $sumRe^+ < |sumRe^-|$:

$$Q = \frac{\left(1 - \frac{sumRe^+}{|sumRe^-|}\right)(|sumRe^-|)^2 + \left(1 - \frac{|sumIm^-|}{sumIm^+}\right)(sumIm^+)^2}{(|sumRe^-|)^2 + (sumIm^+)^2}$$

if $sumIm^+ < |sumIm^-|$ and $sumRe^+ \geq |sumRe^-|$:

$$Q = \frac{\left(1 - \frac{|sumRe^-|}{sumRe^+}\right)(sumRe^+)^2 + \left(1 - \frac{sumIm^+}{|sumIm^-|}\right)(|sumIm^-|)^2}{(sumRe^+)^2 + (|sumIm^-|)^2}$$

if $sumIm^+ < |sumIm^-|$ and $sumRe^+ < |sumRe^-|$:

$$Q = \frac{\left(1 - \frac{sumRe^+}{|sumRe^-|}\right)(|sumRe^-|)^2 + \left(1 - \frac{sumIm^+}{|sumIm^-|}\right)(|sumIm^-|)^2}{(|sumRe^-|)^2 + (|sumIm^-|)^2}$$

wherein sumRe+ is a sum of positive real parts of complex-valued spectral domain values of the input audio signals;

wherein sumRe− is a sum of negative real parts of complex-valued spectral domain values of the input audio signals;

wherein sumIm+ is a sum of positive imaginary parts of complex-valued spectral domain values of the input audio signals; and wherein sumIm− is a sum of negative imaginary parts of complex-valued spectral domain values of the input audio signals.

32. A method for providing a downmix signal on the basis of a plurality of input signals, wherein the method comprises determining a magnitude value of a spectral domain value of the downmix signal on the basis of a loudness information of the input signals, and wherein the method comprises determining a phase value of the spectral domain value of the downmix signal; and wherein the method comprises applying the phase value in order to acquire a complex valued number representation of the spectral domain value of the downmix signal on the basis of the magnitude value of the spectral domain value of the downmix signal;

wherein the method comprises determining a reference magnitude value on the basis of a plurality of input signals; and wherein the method comprises scaling the reference magnitude value, which is unaffected by constructive and destructive interference of the input signals, to determine the magnitude value of the spectral domain value of the downmix signal such that the magnitude value is selectively reduced with respect to a reference value, which corresponds to a sum loudness of spectral domain values of the input signals, at time instances at which a cancellation degree information determined by the downmixer indicates a comparatively large destructive interference between the input signals, and such that the magnitude value is selectively increased with respect to the reference value at time instances at which the cancellation degree information indicates a comparatively small destructive interference between the input signals.

33. A method for providing a downmix signal on the basis of a plurality of input signals, wherein the method comprises determining a magnitude value of a spectral domain value of the downmix signal on the basis of a loudness information of the input signals, and wherein the method comprises determining a phase value of the spectral domain value of the downmix signal; and wherein the method comprises applying the phase value in order to acquire a complex valued number representation of the spectral domain value of the downmix signal on the basis of the magnitude value of the spectral domain value of the downmix signal;

wherein the method comprises acquiring an updated smoothened cancellation degree value Qsmooth(t) on the basis of a previous smoothened cancellation degree value Qsmooth(t−1) and on the basis of an instant cancellation degree value Q(t) according to $$Q_{smooth}(t)=P*Q_{smooth}(t-1)+(p-1)*Q(t)$$

wherein p is a constant with 0<p<1;

and wherein the method comprises acquiring a mapped cancellation degree value Qmapped according to $$Q_{mapped}(t)=(Q(t)+1)^{(Q_{smooth}(t)^{-T})}-1$$

wherein T is a constant with 0<T<1;

wherein Q(t) is in a range between 0 and 1 and takes a value of 0 for a comparatively large destructive interference between the input signals and takes a value of 1 for a comparatively small destructive interference between the input signals;

wherein the method comprises scaling a reference magnitude value using the mapped cancellation degree value, to acquire the magnitude value.

34. A method for providing a downmix signal on the basis of a plurality of input signals, wherein the method comprises determining a magnitude value of a spectral domain value of the downmix signal on the basis of a loudness information of the input signals, and wherein the method comprises determining a phase value of the spectral domain value of the downmix signal; and wherein the method comprises applying the phase value in order to acquire a complex valued number representation of the spectral domain value of the downmix signal on the basis of the magnitude value of the spectral domain value of the downmix signal;

wherein the method comprises acquiring an updated smoothened cancellation degree value Qsmooth(t) on the basis of a previous smoothened cancellation degree value Qsmooth(t−1) and on the basis of an instant cancellation degree value Q(t) according to $$Q_{smooth}(t)=p*Q_{smooth}(t-1)+(p-1)*Q(t)$$

wherein p is a constant with 0<=p<=1;

and wherein the method comprises acquiring a mapped cancellation degree value Qmapped according to $$m_{slope}(t)=\max\{G*Q_{smooth}(t)-1,1\}$$

$$Q_{mapped}(t)=\min\{m_{slope}(t)*Q(t),1\}$$

wherein G is a predetermined value or a constant value between 0.5 and 20 or between 1 and 10;

wherein $m_{slope}(t)$ is an auxiliary variable;

wherein max{ } is a maximum operator;

wherein min{ } is a minimum operator;

wherein Q(t) is in a range between 0 and 1 and takes a value of 0 for a comparatively large destructive interference between the input signals and takes a value of 1 for a comparatively small destructive interference between the input signals;

wherein the method comprises scaling a reference magnitude value using the mapped cancellation degree value, to acquire the magnitude value.

35. A method for providing a downmix signal on the basis of a plurality of input signals, wherein the method comprises determining a magnitude value of a spectral domain value of the downmix signal on the basis of a loudness information of the input signals, and wherein the method comprises determining a phase value of the spectral domain value of the downmix signal; and wherein the method comprises applying the phase value in order to acquire a complex valued number representation of the spectral domain value of the downmix signal on the basis of the magnitude value of the spectral domain value of the downmix signal;

wherein the method comprises determining a weighted sum of spectral domain values of the input signals and determining the phase value on the basis of the weighted sum of spectral domain values of the input signals, wherein the method comprises weighting spectral domain values of the input signals in such a way to avoid destructive interference which is larger than a predetermined interference level, to acquire the weighted sum;

wherein the method comprises determining loudness values of spectral domain values of the input signals, and wherein the method comprises deriving a sum loudness value associated with the spectral domain value of the downmix signal on the basis of the loudness values of the spectral domain values of the input signals; and wherein the method comprises deriving the magnitude value of the spectral domain value of the downmix signal from the sum loudness value.

36. A method for providing a downmix signal on the basis of a plurality of input signals, wherein the method comprises determining a magnitude value of a spectral domain value of the downmix signal on the basis of a loudness information of the input signals, and wherein the method comprises determining a phase value of the spectral domain value of the downmix signal; and wherein the method comprises applying the phase value in order to acquire a complex valued number representation of the spectral domain value of the downmix signal on the basis of the magnitude value of the spectral domain value of the downmix signal;

wherein the method comprises determining a weighted sum of spectral domain values of the input signals and determining the phase value on the basis of the weighted sum of spectral domain values of the input signals, wherein the method comprises weighting spectral domain values of the input signals in dependence on a time-averaged intensity of the respective spectral bin in different input signals using weighting values, to acquire the weighted sum;

wherein the method comprises determining loudness values of spectral domain values of the input signals, and wherein the method comprises deriving a sum loudness value associated with the spectral domain value of the downmix signal on the basis of the loudness values of the spectral domain values of the input signals; and wherein the method comprises deriving the magnitude value of the spectral domain value of the downmix signal from the sum loudness value;

wherein the method comprises forming an average over spectral domain values of a plurality of spectral bins of a first of the input signals which are associated with the same frequency and which are associated with subsequent times, to acquire a first of the weighting values for the first input signal, and wherein the method comprises forming an average over spectral domain values of a plurality of spectral bins of a second of the input signals which are associated with the same frequency and which are associated with subsequent times, to acquire a second of the weighting values for the second input signal.

37. A non-transitory digital storage medium having stored thereon a computer program for performing a method for providing a downmix signal on the basis of a plurality of input signals according to any of claims 29 to 36, when said computer program is run by a computer.

* * * * *